US007228081B2

(12) United States Patent
Hasegawa et al.

(10) Patent No.: US 7,228,081 B2
(45) Date of Patent: Jun. 5, 2007

(54) METHOD AND APPARATUS FOR IMAGE FORMING CAPABLE OF CONTROLLING IMAGE-FORMING PROCESS CONDITIONS

(75) Inventors: Shin Hasegawa, Chiba-ken (JP); Shinji Kato, Kanagawa-ken (JP); Noboru Sawayama, Tokyo-to (JP); Takashi Enami, Kanagawa-ken (JP); Fukutoshi Uchida, Kanagawa-ken (JP); Shinji Kobayashi, Kanagawa-ken (JP); Hitoshi Ishibashi, Kanagawa-ken (JP); Kohta Fujimori, Kanagawa-ken (JP); Naoto Watanabe, Chiba-ken (JP); Kayoko Ikegami, Chiba-ken (JP); Yushi Hirayama, Tokyo-to (JP); Kazumi Kobayashi, Tokyo-to (JP)

(73) Assignee: Ricoh Co., Ltd., Tokyo (JP)

( * ) Notice: Subject to any disclaimer, the term of this patent is extended or adjusted under 35 U.S.C. 154(b) by 116 days.

(21) Appl. No.: 11/083,138

(22) Filed: Mar. 18, 2005

(65) Prior Publication Data

US 2005/0207766 A1 Sep. 22, 2005

(30) Foreign Application Priority Data

Mar. 18, 2004 (JP) ..... 2004-079295

(51) Int. Cl.
*G03G 15/00* (2006.01)
*G03G 21/14* (2006.01)

(52) U.S. Cl. ..... 399/38; 399/76

(58) Field of Classification Search ..... 399/9, 399/38, 75, 76, 87

See application file for complete search history.

(56) References Cited

U.S. PATENT DOCUMENTS 5,182,600 A 1/1993 Hasegawa et al.
5,198,861 A 3/1993 Hasegawa et al.
5,229,815 A * 7/1993 Sulenski ..... 399/38 X (Continued)

FOREIGN PATENT DOCUMENTS

JP 05-323704 12/1993

(Continued)

OTHER PUBLICATIONS

U.S. Appl. No. 11/169,670, filed Jun. 30, 2005, Fujimori et al.
U.S. Appl. No. 11/477,673, filed Jun. 30, 2006, Watanabe, et al.

*Primary Examiner*—Sandra L. Brase
(74) *Attorney, Agent, or Firm*—Oblon, Spivak, McClelland, Maier & Neustadt, P.C.

(57) ABSTRACT

An image forming apparatus includes an image forming mechanism and a process controller. The process controller is configured to instruct the image forming mechanism to perform an image forming operation and a control operation of image forming process conditions. The control operation includes at least two phases each executable at an individual time. The process controller instructs the image forming mechanism to perform the control operation by executing the at least two phases in order of execution frequency from the highest execution frequency to the lowest execution frequency, and discontinue sequential execution of the at least two phases in accordance with an image output command to preferentially perform the image output operation in accordance with the image output command. An image forming method is also described.

81 Claims, 23 Drawing Sheets

U.S. PATENT DOCUMENTS

| | | | | |
|---|---|---|---|---|
| 5,237,370 | A | | 8/1993 | Murai |
| 5,327,196 | A | | 7/1994 | Kato et al. |
| 5,387,965 | A | | 2/1995 | Hasegawa et al. |
| 5,475,476 | A | | 12/1995 | Murai et al. |
| 5,508,787 | A | | 4/1996 | Hasegawa et al. |
| 5,682,572 | A | | 10/1997 | Murai et al. |
| 5,857,131 | A | | 1/1999 | Hasegawa |
| 5,860,038 | A | | 1/1999 | Kato et al. |
| 6,055,386 | A | | 4/2000 | Kato et al. |
| 6,160,968 | A | * | 12/2000 | Noda ..... 399/75 X |

FOREIGN PATENT DOCUMENTS

| | | |
|---|---|---|
| JP | 08-123109 | 5/1996 |
| JP | 09-314903 | * 12/1997 |
| JP | 10-114128 | 5/1998 |
| JP | 10-240082 | 9/1998 |
| JP | 2002-108141 | 4/2002 |
| JP | 2002-132097 | 5/2002 |
| JP | 2002-196546 | 7/2002 |
| JP | 2002-229278 | 8/2002 |
| JP | 2003-091109 | 3/2003 |

* cited by examiner

| FIG. 4A |
| --- |
| FIG. 4B |

FIG. 9

| PHASE | EXECUTION TIME | | EXECUTION FREQUENCY | |
|---|---|---|---|---|
| | SECOND | PRIORITY ORDER A | EXECUTION TIMING | PRIORITY ORDER B |
| 1 | 7 | – | UPON POWER-ON OF IMAGE FORMING APPARATUS | – |
| 2 | 8 | 3 | AFTER CONSECUTIVE OUTPUT OF 100 SHEETS OR AFTER JOB OF AT LEAST 50 ACCUMULATED SHEETS | 2 |
| 3 | 1 | 1 | AFTER OUTPUT OF 1 SHEET | 1 |
| 4 | 5 | 2 | AFTER JOB OF AT LEAST 1000 ACCUMULATED SHEETS | 5 |
| 5 | 10 | 4 | AFTER JOB OF AT LEAST 1000 ACCUMULATED SHEETS | 5 |
| 6 | 10 | 4 | AFTER JOB OF AT LEAST 300 ACCUMULATED SHEETS | 4 |
| 7 | 12 | 5 | AFTER JOB OF AT LEAST 100 ACCUMULATED SHEETS | 3 |
| 8 | 15 | – | UPON POWER-ON OF IMAGE FORMING APPARATUS AND CONSTANTLY DURING JOB | – |

FIG. 10

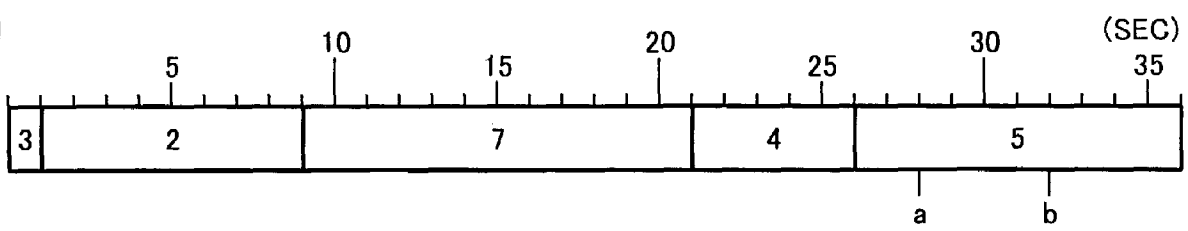

FIG. 11

| PHASE | EXECUTION TIME | | EXECUTION FREQUENCY | |
|---|---|---|---|---|
| | SECOND | PRIORITY ORDER C | EXECUTION TIMING | PRIORITY ORDER D |
| 1 | 7 | 3 | AFTER JOB OF AT LEAST 2000 ACCUMULATED SHEETS | 6 |
| 2 | 8 | 4 | AFTER CONSECUTIVE OUTPUT OF 100 SHEETS OR AFTER JOB OF AT LEAST 50 ACCUMULATED SHEETS | 2 |
| 3 | 1 | 1 | AFTER OUTPUT OF 1 SHEET | 1 |
| 4 | 5 | 2 | AFTER JOB OF AT LEAST 1000 ACCUMULATED SHEETS | 5 |
| 5 | 10 | 5 | AFTER JOB OF AT LEAST 1000 ACCUMULATED SHEETS | 5 |
| 6 | 10 | 5 | AFTER JOB OF AT LEAST 250 ACCUMULATED SHEETS | 4 |
| 7 | 12 | 6 | AFTER JOB OF AT LEAST 100 ACCUMULATED SHEETS | 3 |
| 8 | 15 | – | CONSTANTLY DURING JOB | – |

FIG. 19

| PHASE | EXECUTION TIME | | EXECUTION FREQUENCY | |
|---|---|---|---|---|
| | SECOND | PRIORITY ORDER E | EXECUTION TIMING | PRIORITY ORDER F |
| 1 | 7 | 3 | AFTER JOB OF AT LEAST 2300 ACCUMULATED SHEETS | 7 |
| 2 | 8 | 4 | AFTER CONSECUTIVE OUTPUT OF 90 SHEETS OR AFTER JOB OF AT LEAST 45 ACCUMULATED SHEETS | 2 |
| 3 | 1 | 1 | AFTER OUTPUT OF 1 SHEET | 1 |
| 4 | 5 | 2 | AFTER JOB OF AT LEAST 800 ACCUMULATED SHEETS | 5 |
| 5 | 10 | 5 | AFTER JOB OF AT LEAST 1100 ACCUMULATED SHEETS | 6 |
| 6 | 10 | 5 | AFTER JOB OF AT LEAST 350 ACCUMULATED SHEETS | 4 |
| 7 | 12 | 6 | AFTER JOB OF AT LEAST 130 ACCUMULATED SHEETS | 3 |
| 8 | 15 | – | CONSTANTLY DURING JOB | – |

METHOD AND APPARATUS FOR IMAGE FORMING CAPABLE OF CONTROLLING IMAGE-FORMING PROCESS CONDITIONS

CROSS REFERENCE TO RELATED APPLLICATION

This application claims priority under 35 U.S.C. § 119(a) to Japanese patent application no. 2004-079295, filed on Mar. 18, 2004, the disclosure of which is incorporated by reference herein in its entirety.

BACKGROUND OF THE INVENTION

1. Field of the Invention

This patent specification relates to a method and apparatus for image forming, and more particularly to a method and apparatus such as a copier, a printer, and a facsimile used for image forming in accordance with an electrographic method, capable of effectively controlling image forming process conditions.

2. Discussion of the Related Art

In a typical electrographic image forming apparatus such as a copier, a printer, and a facsimile, performances and characteristics of supplies such as a development agent and a photoconductor used in the apparatus vary over time or by environmental factors. Therefore, image forming process conditions should be appropriately controlled and adjusted in response to such variations in the performances and characteristics of the supplies so as to stably maintain image quality.

As is disclosed in Japanese Laid-Open patent publication no. 2002-108141, for example, in a control operation of the image forming process conditions (hereinafter referred to simply as condition control), variable factors are detected by a sensor and the like, and a feedback operation is performed so that conditions of image-formation-related units, such as a charging voltage level and a toner supply amount, are optimized. In this detection of the variable factors, an error range increases if the detection is based on data obtained at one moment of time. The detection thus should be based on a plurality of data values obtained at predetermined time intervals. As a result, the detection takes a certain amount of time.

Further, since the image-formation-related units are operated during the condition control, an image forming operation is suspended during the condition control. Therefore, an image output operation such as output of printed or photocopied sheets (hereinafter referred to as a job) is not accepted during the condition control. This results in down time of the image forming apparatus, causing dissatisfaction among users. In recent years, this dissatisfaction among users has been increasing with the spread of color image forming apparatuses. This is because a color image forming apparatus needs to execute the condition control for each of image forming units of four different colors black (K), cyan (C), yellow (Y), and magenta (M), taking four times as long for the condition control compared with a monochrome image forming apparatus in which only one image forming unit of the black color goes through the condition control. If the image forming process conditions are not controlled, the users are saved from waiting, but image quality is deteriorated.

In light of the above, according to Japanese Laid-Open patent publication no. 2002-108141, the job is performed even during the condition control. Since the condition control is discontinued, however, the condition control should be executed again from the beginning. As a result, although inconvenience for the users may be temporarily avoided, if a relatively long condition control is discontinued and then executed again from the beginning, longer time is taken in total for completing the condition control than for completing a typical condition control generally used. The patent publication also discloses a method of resuming the condition control starting from a discontinued phase of the condition control. According to the method, however, a particular discontinued phase of the condition control is not recognized, and thus a relatively long phase tends to be discontinued and re-executed in the resumed condition control. As a result, a longer time is taken in total for completing the condition control than for completing the typical condition control, as in the above case.

On the other hand, Japanese Laid-Open patent publication no. 2003-091109, for example, discloses a method of suspending the condition control during a job or when it is highly possible that the job is being performed. If the condition control continues to be suspended even after it becomes necessary to execute the condition control; however, the image quality eventually deteriorates. Therefore, the job should be discontinued at some point in time to execute the condition control.

In light of the above, according to Japanese Laid-Open patent publication no. 2002-132097, for example, a decision of whether or not to execute the condition control is left up to users. In this case, a user presses a predetermined button provided on the image forming apparatus depending on the decision. This method, however, is effective only when the user is in the vicinity of the image forming apparatus, as in a case of a copier.

Further, according to Japanese Laid-Open patent publication no. 10-114128, for example, when it becomes necessary, during an ongoing job, to execute the condition control, a decision of whether or not to discontinue the job is made in consideration of the type of the job. Thereafter, a predetermined action is taken, such as not discontinuing the ongoing job, immediately discontinuing the ongoing job, and discontinuing the ongoing job after output of a predetermined number of sheets. Furthermore, Japanese Laid-Open patent publication no. 2002-229278, for example, uses a particular accumulated number of output sheets as a condition for starting the condition control. Both of the above methods address responses to be made when the execution of the control operation becomes necessary during an ongoing job, but not the responses to be made when a request for a job is received during an ongoing condition control.

In light of the above, Japanese Laid-Open patent publication no. 9-314903, for example, discloses an image forming apparatus which executes a condition control formed by combining a plurality of phases each designed to complete in relatively short time. According to this image forming apparatus, when a print output signal is issued during the condition control, a phase of the condition control being performed at the issuance of the signal is completed. Then, a phase scheduled to be performed after completion of the phase is suspended to preferentially perform a print output operation. As a result, the image forming apparatus can perform an operation requested by a user, without keeping the user waiting long. This method, however, has an open question of how the discontinued condition control should be resumed to stably maintain image quality.

FIG. 1 is a graph indicating a relationship between a waiting time for users and a degree of dissatisfaction the users have toward the waiting time (hereinafter referred to as dissatisfaction degree). In this graph, the horizontal axis represents the waiting time for users, and the vertical axis represents the dissatisfaction degree. The present inventors conducted research to find a time range allowable for adjustment of the image forming process conditions. From a result of the research, the relationship between the waiting time for users and the dissatisfaction degree can be expressed as in a sigmoid function $D=1/(1+EXP(-k2*Ln(t/k1)))*100(\%)$, wherein D indicates the dissatisfaction degree, EXP indicates an exponential function, k2 indicates a constant indicating steepness of a rising edge of the sigmoid function, Ln indicates a natural logarithm, t indicates time, and k1 indicates a time scale constant. The parameter k1 ranges from 9 to 15 seconds and the parameter k2 ranges from 2 to 3. These parameters vary depending on such factors as the type of image forming apparatus (i.e., printing speed of the image forming apparatus) and the way the image forming apparatus is used. It is observed from the graph of FIG. 1 that most of research subjects do not have dissatisfaction toward a waiting time of within approximately four to five seconds, a half of the research subjects have dissatisfaction toward a waiting of approximately nine to fifteen seconds, and most of the research subjects have dissatisfaction toward a waiting time exceeding approximately thirty seconds.

SUMMARY OF THE INVENTION

This patent specification describes an image forming apparatus. In one example, an image forming apparatus includes an image forming mechanism and a process controller. The image forming mechanism is configured to perform an image forming operation and a control operation of image forming process conditions. The control operation includes at least two phases each executable at an individual time. The process controller is configured to instruct the image forming mechanism to perform the control operation by executing the at least two phases in an order of execution frequency from the highest execution frequency to the lowest execution frequency, and to discontinue sequential execution of the at least two phases forming the control operation in accordance with an image output command to preferentially perform an image output operation in accordance with the image output command.

Further, this patent specification describes another image forming apparatus. In one example, this image forming apparatus includes an image forming mechanism and a process controller. The image forming mechanism is configured to perform an image forming operation and a control operation of image forming process conditions. The control operation includes at least two phases each executable at an individual time. The process controller is configured to instruct the image forming mechanism to perform the control operation by executing the at least two phases in an order of execution time length from the shortest time length to longest time length, and discontinue sequential execution of the at least two phases forming the control operation in accordance with an image output command to preferentially perform an image output operation in accordance with the image output command.

Furthermore, this patent specification describes still another image forming apparatus. In one example, this image forming apparatus includes an image forming mechanism, a first memory, and a process controller. The image forming mechanism is configured to perform an image forming operation and a control operation of image forming process conditions. The control operation includes at least two phases each executable at an individual time. The process controller is configured to instruct the image forming mechanism to perform the control operation, discontinue sequential execution of the at least two phases forming the control operation in accordance with an image output command to preferentially perform an image output operation in accordance with the image output command, store in the first memory data of discontinuation frequency of discontinued phases, and perform the discontinued phases in an order of discontinuation frequency from the highest discontinuation frequency to the lowest discontinuation frequency.

In the image forming apparatuses according to the present invention, the process controller may instruct the image forming mechanism to discontinue the control operation upon receipt of the image output command.

Further, in the image forming apparatuses according to the present invention, the process controller may instruct the image forming mechanism to discontinue the control operation upon completion of a phase of the control operation during which the image output command is received.

Further, in the image forming apparatuses according to the present invention, when the process controller receives the image output command during a phase of the control operation, the process controller may instruct the image forming mechanism to immediately discontinue the control operation, if remaining time before completion of the phase is equal to or more than a predetermined time, and to discontinue the control operation upon completion of the phase, if the remaining time before completion of the phase is less than the predetermined time.

Further, in the image forming apparatuses according to the present invention, the predetermined time may be set to be an arbitrary value.

Further, in the image forming apparatuses according to the present invention, the process controller may instruct the image forming mechanism to resume discontinued phases of the control operation after (preferably immediately after) completion of the image output operation.

Further, in the image forming apparatuses according to the present invention, the process controller may instruct the image forming mechanism to resume discontinued phases of the control operation after elapse of a predetermined time since completion of the image output operation.

Further, in the image forming apparatuses according to the present invention, the predetermined time may be determined in accordance with the number of sheets output in the image output operation.

Further, in the image forming apparatuses according to the present invention, the predetermined time may be set to be zero when the number of sheets output in the image output operation exceeds a predetermined value.

Further, in the image forming apparatuses according to the present invention, the predetermined time may be set to be an arbitrary value.

Further, in the image forming apparatuses according to the present invention, when timing of resuming the discontinued phases of the control operation arrives during another image output operation, the process controller may instruct the image forming mechanism to resume the discontinued phases upon completion of the another image output operation.

Further, in the image forming apparatuses according to the present invention, the process controller may instruct the image forming mechanism to perform the discontinued phases of the control operation in an order of execution time length from the shortest time length to the longest time length, regardless of a priority order given to the phases prior to discontinuation of the control operation.

Further, in the image forming apparatuses according to the present invention, the process controller may instruct the image forming mechanism to perform the discontinued phases of the control operation in an order of execution frequency from the highest execution frequency to the lowest execution frequency, regardless of a priority order given to the phases prior to discontinuation of the control operation.

Further, in the image forming apparatuses according to the present invention, if the number of sheets output from the image forming apparatus exceeds, by a predetermined value, a predetermined number of sheets allowed to be output in a phase of the resumed control operation, the process controller may instruct the image forming mechanism to preferentially perform the phase. The predetermined number of sheets may determine an execution frequency of the phase.

Further, in the image forming apparatuses according to the present invention, the predetermined value may be expressed by an integer number obtained by multiplying the predetermined number of sheets by a predetermined rate.

Further, in the image forming apparatuses according to the present invention, when the process controller receives another image output command after discontinuation of the control operation, the process controller may change an execution order of the discontinued phases of the control operation in accordance with the number of sheets requested to be output by the another image output command, regardless of a priority order given to the phases prior to the discontinuation of the control operation.

Further, in the image forming apparatuses according to the present invention, when the process controller receives another image output command during a phase of the resumed control operation, the process controller may instruct the image forming mechanism to discontinue the resumed control operation again after completion of the phase.

Further, in the image forming apparatuses according to the present invention, when the process controller receives another image output command, the process controller may instruct the image forming mechanism not to discontinue the resumed control operation again.

Further, in the image forming apparatuses according to the present invention, when the process controller determines either one of events that any operation is being performed in accordance with the image output command and that the image output operation is being performed, the process controller may instruct the image forming mechanism to suspend at least either one of start of the control operation and resumption of the discontinued control operation.

Further, in the image forming apparatuses according to the present invention, when the process controller determines either one of events that any operation is being performed in accordance with the image output command and that the image output operation is being performed, the process controller may instruct the image forming mechanism to immediately perform a phase of the control operation, if the number of sheets output from the image forming apparatus exceeds, by a predetermined value, a predetermined number of sheets allowed to be output in the phase which determines an execution frequency of the phase.

Further, in the image forming apparatuses according to the present invention, the predetermined value may be expressed by an integer number obtained by multiplying the predetermined number of sheets by a predetermined rate.

Further, the image forming apparatuses according to the present invention may further include a second memory configured to previously store image data to be output. Accordingly, when execution timing of the control operation arrives in a state in which an image output operation is being performed and requests for a plurality of other image output operations are accumulated in the second memory, the process controller may change, after completion of the ongoing image output operation, an execution order of at least either one of the plurality of other image output operations and the phases of the control operation in accordance with the number of sheets to be output in each of the plurality of other image output operations.

Further, in the image forming apparatuses according to the present invention, when the control operation includes a plurality of respective phases, the process controller may instruct the image forming mechanism to arrange the plurality of phases of the control operation in order of execution time length from the shortest time length to the longest time length and the plurality of other image output operations in order of the number of sheets to be output from the smallest number to the largest number, and alternately perform the plurality of respective phases and the plurality of other image output operations in the respective arranged orders.

Further, in the image forming apparatuses according to the present invention, when the control operation includes a plurality of respective phases, the process controller may instruct the image forming mechanism to arrange the plurality of respective phases of the control operation in order of execution frequency from the highest execution frequency to the lowest execution frequency and the plurality of other image output operations in order of the number of sheets to be output from the smallest, and alternately perform the plurality of respective phases and the plurality of other image output operations in respective arranged orders.

Further, in the image forming apparatuses according to the present invention, a predetermined number of sheets allowed to be output in a phase of the control operation, which determines the execution frequency of the phase, may be set so as not to be a multiple number of a predetermined number of sheets allowed to be output in another phase of the control operation.

This patent specification further describes an image forming method. In one example, an image forming method includes forming a control operation of image forming process conditions with at least two phases each executable at an individual time, executing the at least two phases of the control operation in order of execution frequency from the highest execution frequency to the lowest execution frequency, discontinuing sequential execution of the at least two phases of the control operation in accordance with an image output command, and performing an image output operation in accordance with the image output command.

Further, this patent specification describes another image forming method. In one example, this image forming method includes forming a control operation of image forming process conditions with at least two phases each executable at an individual time, executing the at least two phases of the control operation in an order of execution time length from the shortest time length to the longest time length, discontinuing sequential execution of the at least two phases of the control operation in accordance with an image output command, and performing an image output operation in accordance with the image output command.

Furthermore, this patent specification describes still another image forming method. In one example, this image forming method includes forming a control operation of image forming process conditions with at least two phases each executable at an individual time, executing the at least two phases of the control operation, discontinuing sequential execution of the at least two phases of the control operation in accordance with an image output command, storing, in a first memory, data of discontinuation frequency of discontinued phases, performing an image output operation in accordance with the image output command, and performing the discontinued phases in order of discontinuation frequency from the highest discontinuation frequency to the lowest discontinuous frequency.

In the preceding image forming method according to the present invention, the discontinuing step may discontinue the control operation upon receipt of the image output command.

Further, in the preceding image forming method according to the present invention, the discontinuing step may discontinue the control operation upon completion of a phase of the control operation during which the image output command is received.

Further, the image forming method according to the present invention may further include receiving the image output command during a phase of the control operation, determining whether remaining time before completion of the phase is equal to or more than a predetermined time, discontinuing the control operation when it is determined that the remaining time is equal to or more than a predetermined time, and discontinuing the control operation upon completion of the phase when it is determined that the remaining time before completion of the phase is less than the predetermined time.

Further, in the image forming methods according to the present invention, the predetermined time may be set to be an arbitrary value.

Further, the image forming methods according to the present invention may further include resuming discontinued phases of the control operation after (preferably immediately after) completion of the image output operation.

Further, the image forming methods according to the present invention may further include resuming discontinued phases of the control operation after elapse of a predetermined time since completion of the image output operation.

Further, in the image forming methods according to the present invention, the predetermined time may be determined in accordance with the number of sheets output in the image output operation.

Further, in the image forming methods according to the present invention, the predetermined time may be set to be zero when the number of sheets output in the image output operation exceeds a predetermined value.

Further, in the image forming methods according to the present invention, the predetermined time may be set to be an arbitrary value.

Further, the image forming methods according to the present invention may further include detecting arrival of timing of resuming the discontinued phases of the control operation during another image output operation, and resuming the discontinued phases upon completion of the another image output operation.

Further, the image forming methods according to the present invention may further include performing the discontinued phases of the control operation in an order of execution time length from the shortest time length to the longest time length, regardless of a priority order given to the phases prior to discontinuation of the control operation.

Further, the image forming methods according to the present invention may further include performing the discontinued phases of the control operation in order of execution frequency from the highest, regardless of a priority order given to the phases prior to discontinuation of the control operation.

Further, the image forming methods according to the present invention may further include detecting that the number of sheets output from the image forming apparatus exceeds, by a predetermined value, a predetermined number of sheets which is allowed to be output in a phase of the resumed control operation and which determines an execution frequency of the phase, and performing the phase of the resumed control operation.

Further, in the image forming methods according to the present invention, the predetermined value may be expressed by an integer number obtained by multiplying the predetermined number of sheets by a predetermined rate.

Further, the image forming methods according to the present invention may further include receiving another image output command after discontinuation of the control operation, and changing an execution order of the discontinued phases of the control operation in accordance with the number of sheets requested to be output by the another image output command, regardless of a priority order given to the phases prior to discontinuation of the control operation.

Further, the image forming methods according to the present invention may further include receiving another image output command during a phase of the resumed control operation, completing the phase, and discontinuing the resumed control operation again.

Further, the image forming methods according to the present invention may further include receiving another image output command, and completing the resumed control operation without discontinuation.

Further, the image forming methods according to the present invention may further include determining either one of that any operation is being performed in accordance with the image output command and that the image output operation is being performed, and suspending at least either one of a start of the control operation and a resumption of the discontinued control operation.

Further, the image forming methods according to the present invention may further include determining either one of that any operation is being performed in accordance with the image output command and that the image output operation is being performed, determining that the number of sheets output from the image forming apparatus exceeds, by a predetermined value, a predetermined number of sheets which is allowed to be output in a phase of the control operation and which determines an execution frequency of the phase, and performing the phase of the control operation.

Further, in the image forming methods according to the present invention, the predetermined value may be expressed by an integer number obtained by multiplying the predetermined number of sheets by a predetermined rate.

Further, the image forming methods according to the present invention may further include performing an image output operation, accumulating, in a second memory configured to previously store image data to be output, requests for a plurality of other image output operations during execution of the image output operation, detecting arrival of execution timing of the control operation, completing the image output operation, changing an execution order of at least either one of the plurality of other image output operations and the phases of the control operation in accordance with the number of sheets to be output in each of the plurality of other image output operations, and performing the plurality of other image output operations and the phases of the control operation in the changed execution order.

Further, the image forming methods according to the present invention may further include including a plurality of respective phases in the control operation, arranging the plurality of respective phases of the control operation in an order of execution time length from the shortest time length to the longest time length and the plurality of other image output operations in an order of the number of sheets to be output from the smallest number to the largest number, and alternately performing the plurality of respective phases of the control operation and the plurality of other image output in operations in respective arranged orders.

Further, the image forming methods according to the present invention may further include including a plurality of respective phases in the control operation, arranging the plurality of respective phases of the control operation in an order of execution frequency from the highest execution frequency to the lowest execution frequency and arranging the plurality of other image output operations in an order of the number of sheets to be output from the smallest number to the longest number, and alternately performing the plurality of phases of the control operation and the plurality of other image output in operations in respective arranged orders.

Further, the image forming methods according to the present invention may further include setting a predetermined number of sheets allowed to be output in a phase of the control operation, which determines the execution frequency of the phase, so as not to be a multiple number of a predetermined number of sheets allowed to be output in another phase of the control operation.

It is to be understood that both the foregoing general description of the invention and the following detailed description are exemplary, but are not restrictive of the invention.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein:

FIG. 9 is a table describing an example of execution time, execution timing, and priority orders assigned to each of the eight phases;

FIG. 10 is a diagram illustrating an example of phase execution order determined under a specific condition;

FIG. 11 is a table describing another example of execution time, execution timing, and priority orders assigned to each of the eight phases;

FIG. 19 is a table for explaining a condition control according to another embodiment of the present invention.

DETAILED DESCRIPTION OF THE PREFERRED EMBODIMENTS

Figure 1:
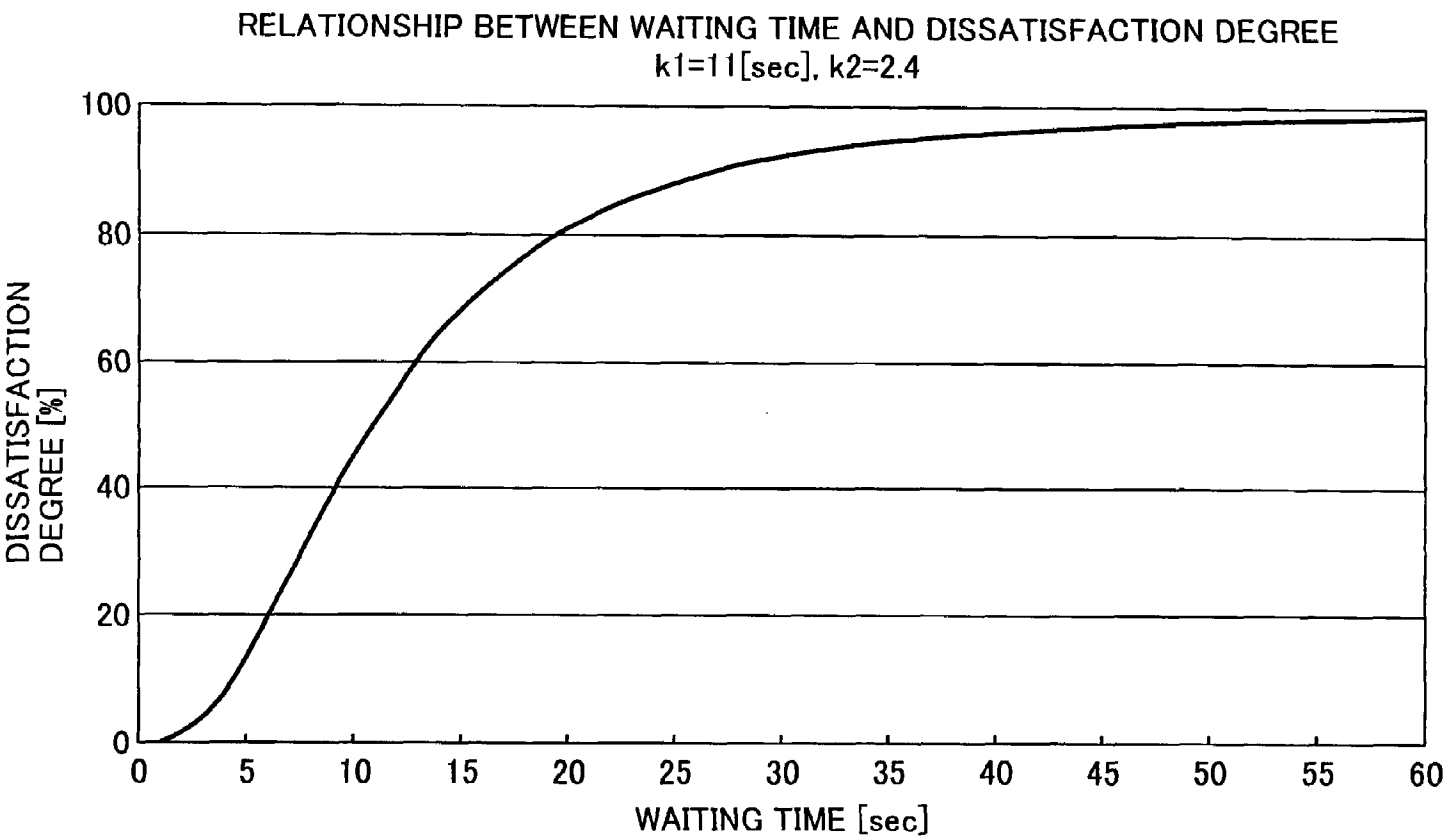
FIG. 1 is a graph indicating a relationship between a waiting time for users and a degree of dissatisfaction the users have toward the waiting time.

In describing preferred embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Figure 2:
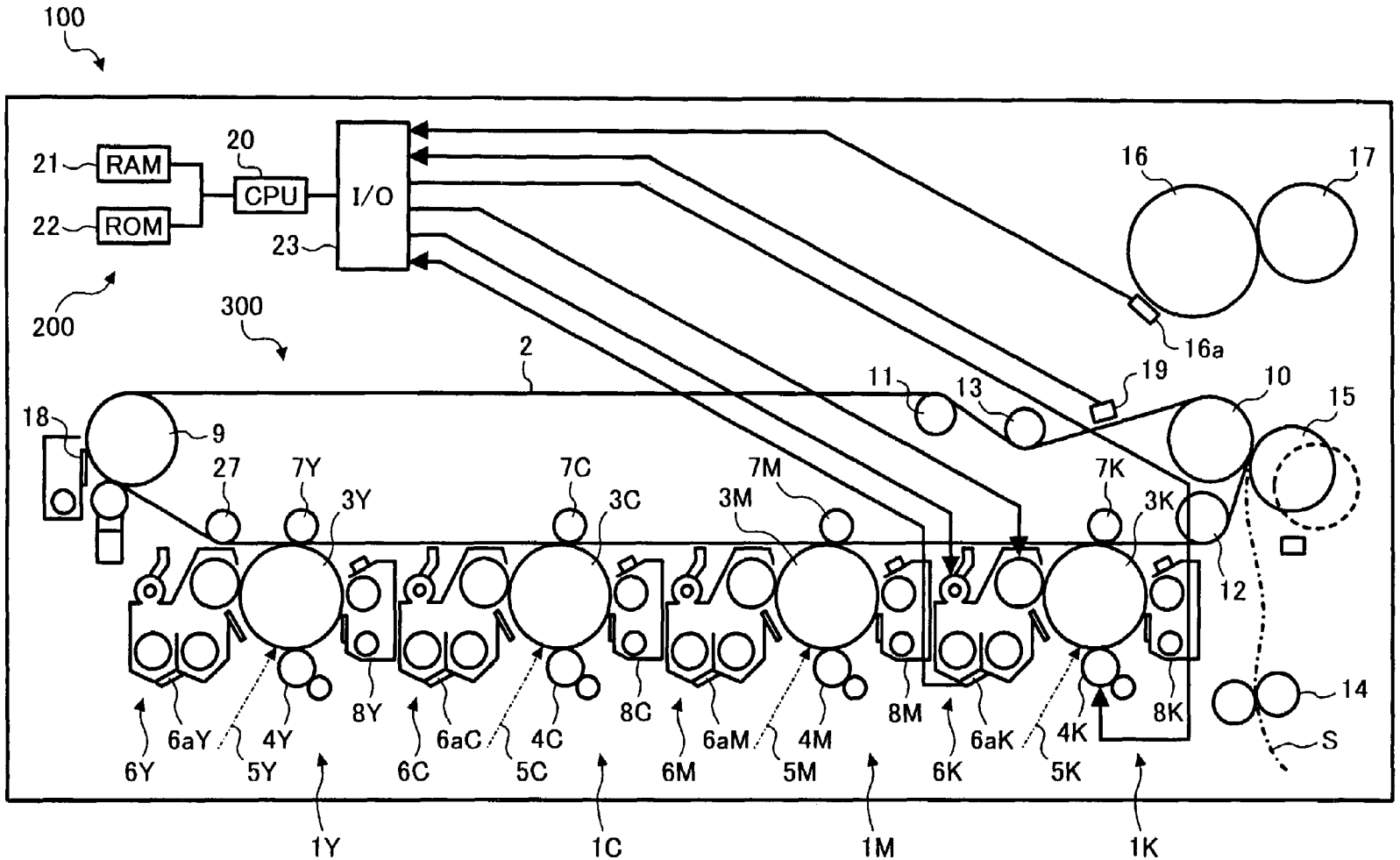
FIG. 2 is a diagram illustrating a layout of an image forming apparatus according to an embodiment of the present invention.

Referring now to the drawings, wherein like reference numerals designate identical or corresponding parts throughout the several views, FIG. 2 illustrates an overall layout of an image forming apparatus 100 according to an embodiment of the present invention.

The image forming apparatus 100 of FIG. 2 includes a process controlling unit 200 and an image forming mechanism 300. The image forming mechanism 300 includes image forming units 1Y, 1C, 1M, and 1K, a transfer belt 2, photoconductors 3Y, 3C, 3M, and 3K, charging units 4Y, 4C, 4M, and 4K, developing units 6Y, 6C, 6M, and 6K, toner density sensors 6*a*Y, 6*a*C, 6*a*M, and 6*a*K, first transferring units 7Y, 7C, 7M, and 7K, cleaning units 8Y, 8C, 8M, and 8K, transfer belt supporting rollers 9, 10, 11, 12, 13, and 27, a resist roller pair 14, a second transferring unit 15, fixing units 16 and 17, a temperature sensor 16*a*, a transfer belt cleaning unit 18, and four reflection-type photo sensors 19. Arrows 5Y, 5C, 5M, and 5K respectively represent LD (laser diode) beams applied for exposure to the corresponding photoconductors 3Y, 3C, 3M, and 3K. The transfer belt 2 is used for performing a first transfer (i.e., intermediate transfer). The transferring unit 15 forms a second transfer stage. The process controlling unit 200 includes a CPU (central processing unit) 20, a RAM (random access memory) 21, a ROM (read only memory) 22, and an I/O (input/output) port 23.

A normal image forming operation is performed by a general method in the image forming apparatus 100 of FIG. 2. The image forming operation performed by the general method is briefly described below. First, an original document placed on a contact glass plate (not shown) is exposed by an exposure lamp (not shown). An obtained reflected light is read by a scanning unit (not shown), and data of the original document is subjected to analog-to-digital conversion. Then, the LD beams 5Y, 5C, 5M, and 5K are applied to the corresponding photoconductors 3Y, 3C, 3M, and 3K, which have been uniformly charged by the corresponding charging units 4Y, 4C, 4M, and 4K. As a result, the analog-to-digital converted data of the original document is written on the photoconductors 3Y, 3C, 3M, and 3K to be formed into electrostatic latent images. The electrostatic latent images formed on the photoconductors 3Y, 3C, 3M, and 3K are then developed into visible toner images by the developing units 6Y, 6C, 6M, and 6K. The toner images formed on the photoconductors 3Y, 3C, 3M, and 3K are transferred first to the transfer belt 2 by the first transferring units 7Y, 7C, 7M, and 7K and then to a transfer sheet S by the second transferring unit 15. Then, the transfer sheet S passes between the fixing units 16 and 17 and is output from the image forming apparatus 100.

The process controlling unit 200 is then briefly described. CPU 20 is connected to the memories RAM 21 and ROM 22 and exchanges data through the I/O port 23 with various components of the image forming mechanism 300. FIG. 2 illustrates, as an example, flows of signals exchanged between the process controlling unit 200 and the image forming unit 1K for the black (K) color. In this example, through the I/O port 23, CPU 20 receives signals output from such sensors as the temperature sensor 16*a*, one of the reflection-type photo sensors 19, and the toner density sensor 6*a*K, and outputs signals to units of the image forming mechanism 300 such as the charging unit 4K and the developing unit 6K. By thus transmitting the signals, the process controlling unit 200 instructs the image forming mechanism 300 to perform the image forming operation and the condition control. Similar signal flows are also observed between the process controlling unit 200 and each of the image forming units 1Y, 1C, and 1M for the other three colors yellow (Y), cyan (C), and magenta (M).

Figure 3:
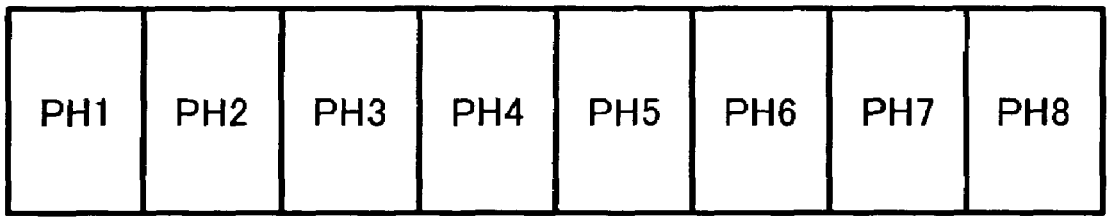
FIG. 3 is a diagram illustrating eight phases forming a condition control according to an embodiment of the present invention.

The condition control is described below. Operation of automatically controlling image forming process conditions around the photoconductors 3Y, 3C, 3M, and 3K includes eight phases PH1 to PH8, as illustrated in FIG. 3. Specifically, the operation includes initial setting of the reflection-type photo sensors (PH1), setting of a toner density control reference value (PH2), control of toner supply (PH3), control of photoconductor surface potential (PH4), control of development potential (PH5), adjustment of halftone (PH6), control of write positions (PH7), and mixing of development agent (PH8). In the image forming apparatus 100 of FIG. 2, a plurality of phases are selected from the above eight phases and sequentially performed in consideration of such factors as the condition of the image forming apparatus 100 and the way the image forming apparatus 100 is used.

In Phase PH1 (i.e., initial setting of the reflection-type photo sensors), an output voltage Vsg output from each of the four reflection-type photo sensors 19 for checking a non-image area of a surface of the transfer belt 2 is set to be 4.0 volts, for example. The output voltage Vsg is changed by such factors as sensitivity of the reflection-type photo sensors 19 and reflectance of the photoconductors 3Y, 3C, 3M, and 3K. Therefore, this phase needs to be performed when the transfer belt 2 or any of the reflection-type photo sensors 19 is replaced with a new one.

Phase PH2 (i.e., setting of a toner density control reference value) is performed to solve such a situation in which an appropriate control level of toner density is changed due to a decrease in amount of charged toner, which is caused by leaving the image forming apparatus 100 unused for a relatively long time. In Phase PH2, the reflection-type photo sensors 19 check toner adhesion patterns (i.e., patterns used in detection of an amount of adhered toner), and a result of the detection is used as a basis for optimizing a control reference value of each of the toner density sensors 6*a*Y, 6*a*C, 6*a*M, and 6*a*K, based on which a toner supply amount is determined. Accordingly, density of toner stored in each of the developing units 6Y, 6C, 6M, and 6K is kept at an optimal level.

Figures 4, 4A:
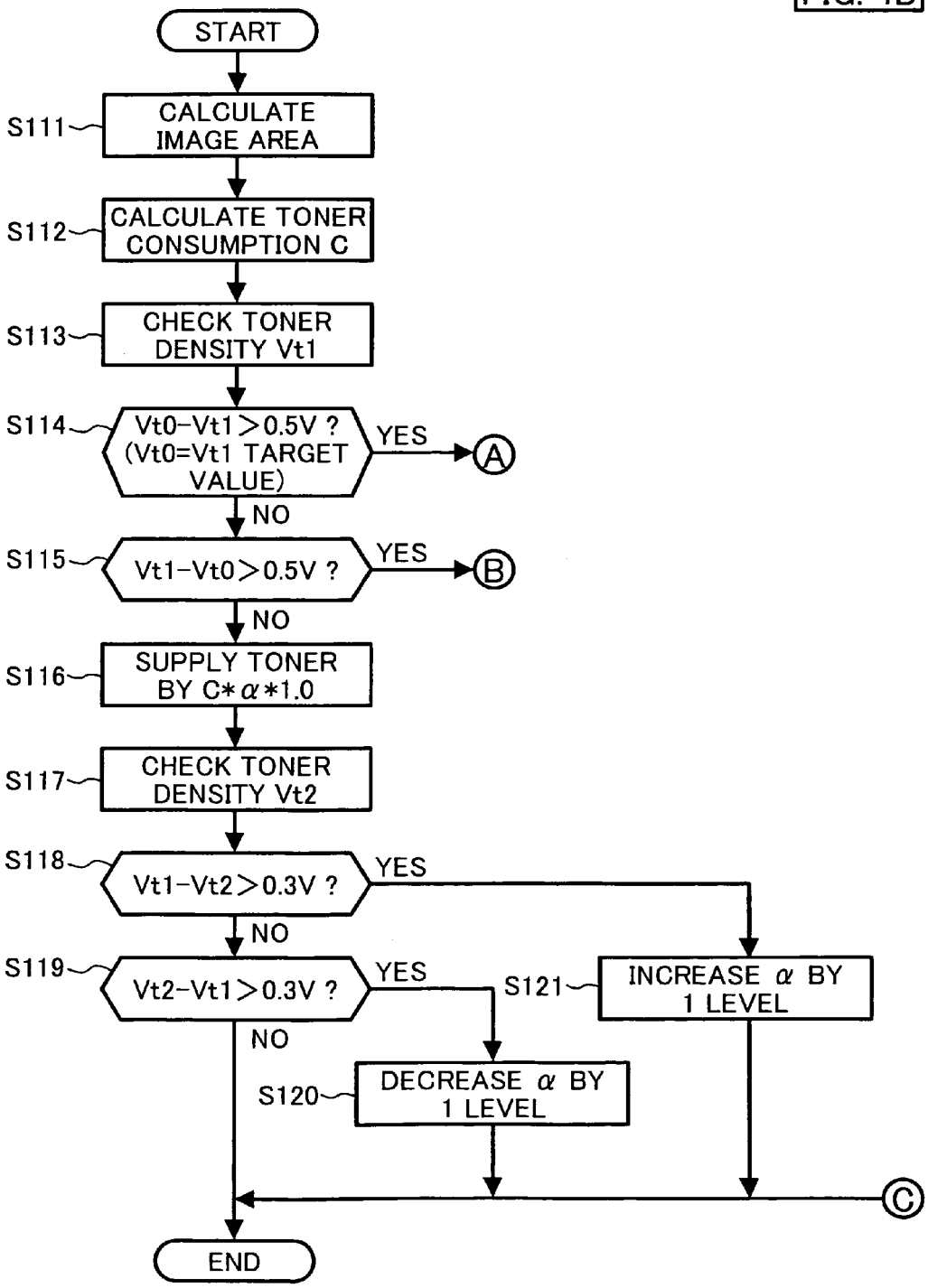
FIGS. 4A and 4B depict a flowchart illustrating an operation of setting a toner density control reference value.
Figure 4B:
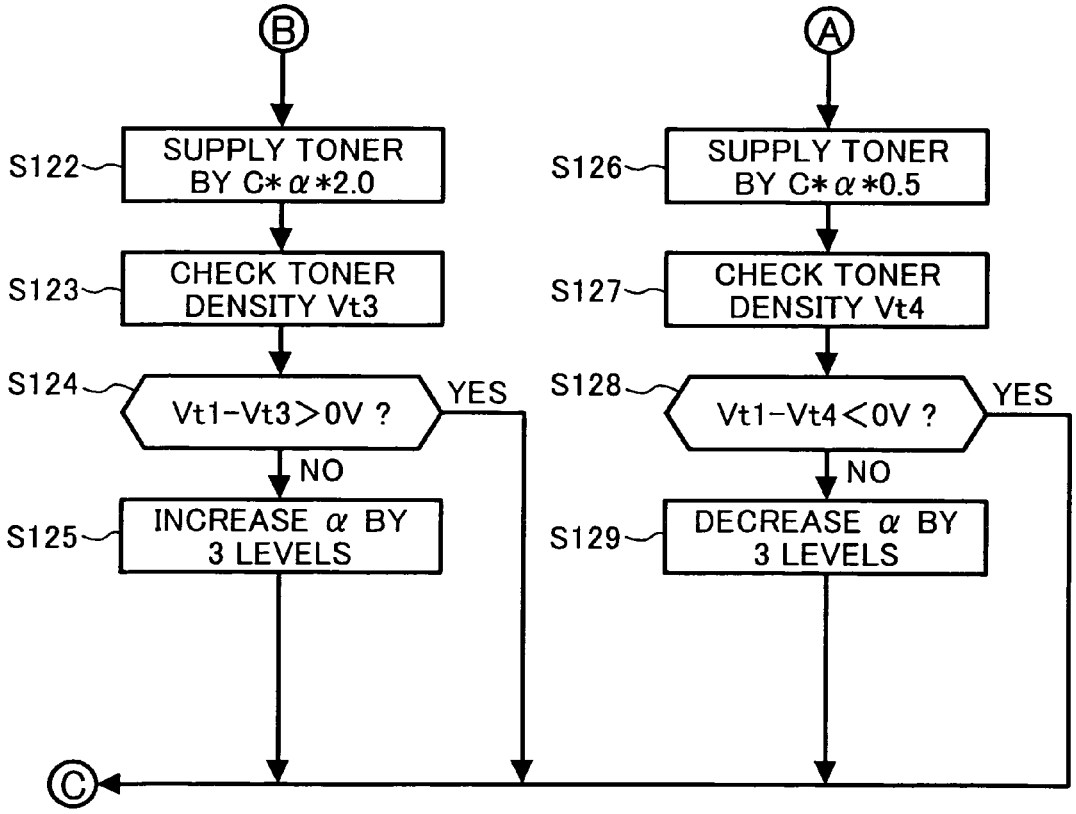

An operation flow of Phase PH2 is described with reference to the flowchart shown in FIGS. 4A and 4B. First, an area of an image to be output is calculated (Step S111). Then, a toner consumption amount C (i.e., an amount of toner consumed for the image) is calculated (Step S112), and a toner density Vt1 is measured (Step S113). If a value calculated by subtracting Vt1 from a Vt1 target value Vt0 is not larger than 0.5 volts, for example (N in Step S114), it is then determined whether a value calculated by subtracting Vt0 from Vt1 is larger than 0.5 volts, for example (Step S115). If the value is not larger than 0.5 volts, for example (NO in Step S115), toner is supplied by an amount C*α*0.1, (Step S16), wherein α indicates a predetermined proportionality coefficient. Then, a toner density Vt2 is measured (Step S117). If a value calculated by subtracting Vt2 from Vt1 is not larger than 0.3 volts, for example (NO in Step S118), it is then determined whether a value calculated by subtracting Vt1 from Vt2 is larger than 0.3 volts, for example (Step S119). If the value is not larger than 0.3 volts, for example (NO in Step S119), the operation flow ends.

On the other hand, if the value calculated by subtracting Vt1 from Vt2 is larger than 0.3 volts, for example (YES in Step S119), the value α is decreased by one level (Step S120), and the operation flow ends. If the value calculated by subtracting Vt2 from Vt1 is larger than 0.3 volts, for example (YES in Step S118), the value α is increased by one level (Step S121), and the operation flow ends.

Further, if the value calculated by subtracting Vt0 from Vt1 is larger than 0.5 volts, for example (YES in Step S115), toner is supplied by an amount C*α*2.O (Step S122). Then, a toner density Vt3 is measured (Step S123). If a value calculated by subtracting Vt3 from Vt1 is larger than 0 volts, for example (YES in Step S124), the operation flow ends. If the calculated value is not larger than 0 volts, for example (NO in Step S124), the value α is increased by three levels (Step S125), and the operation flow ends.

Furthermore, if the value calculated by subtracting Vt1 from Vt0 is larger than 0.5 volts, for example (YES in Step S114), toner is supplied by an amount C*α*0.5 (Step S126). Then, a toner density Vt4 is measured (Step S127). If a value calculated by subtracting Vt4 from Vt1 is smaller than 0 volts, for example (YES in Step S128), the operation flow ends. If the value is not smaller than 0 volts, for example (NO in Step S128), the value α is decreased by three levels (Step S129), and the operation flow ends.

In Phase PH3 (i.e., control of toner supply), in each of the image forming units 1Y, 1C, 1M, and 1K, a toner supply time is first calculated based on an output voltage output from the corresponding toner density sensor 6*a*Y, 6*a*C, 6*a*M, or 6aK, the toner density control reference value, and detected pixel data of an image to be output. Thereafter, a toner supply motor is driven to operate.

Figure 5:
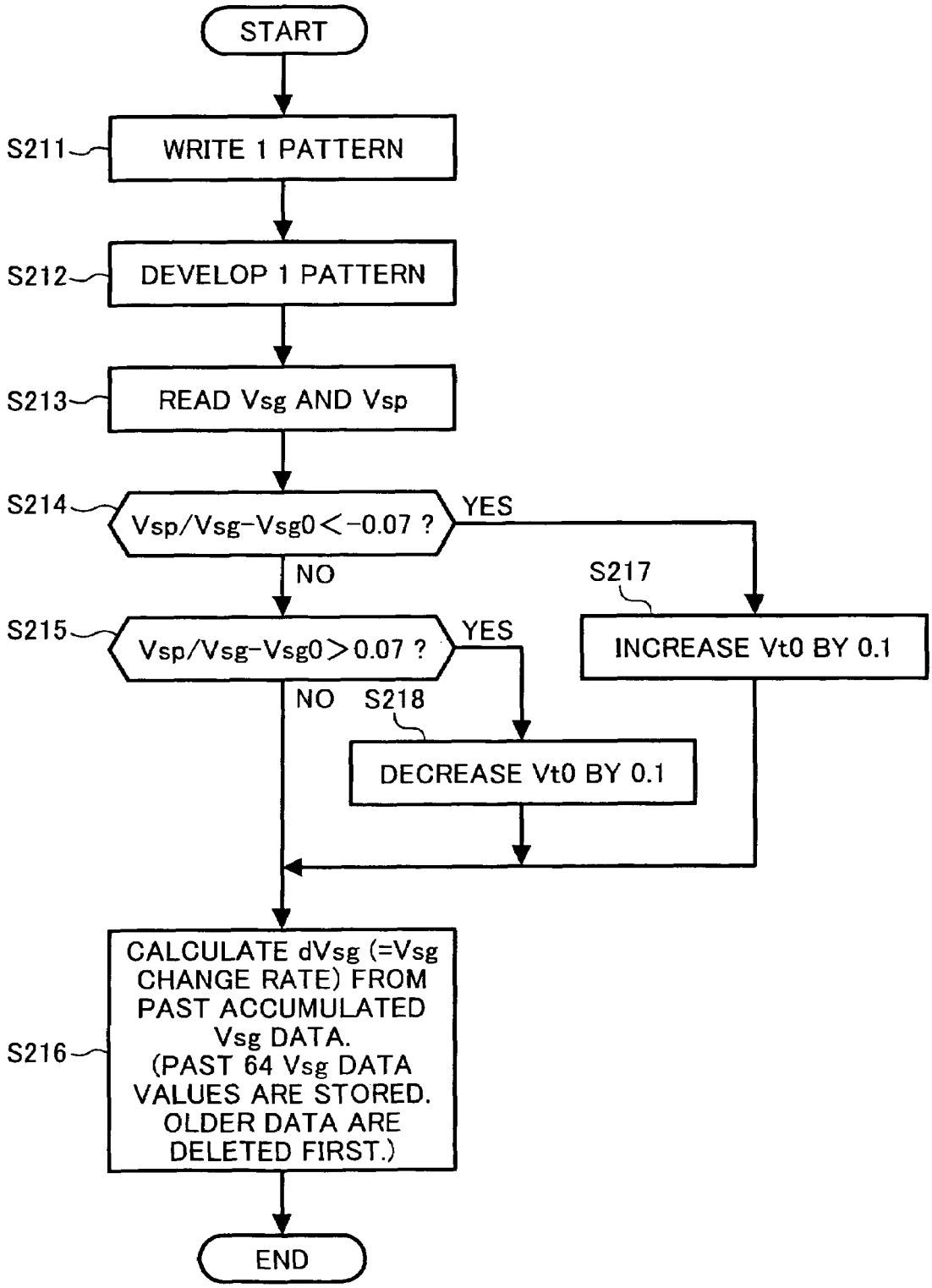
FIG. 5 is a flowchart illustrating an operation of controlling toner supply.

An operation flow of Phase PH3 is described with reference to the flowchart of FIG. 5. In each of the image forming units 1Y, 1C, 1M, and 1K, a toner adhesion pattern is first formed on the corresponding photoconductor 3Y, 3C, 3M, or 3K (Step S211). Then, the toner adhesion pattern is developed (Step S212), and Vsg and Vsp are measured by the corresponding reflection-type photo sensor 19 (Step S213). As described above, Vsg indicates the output voltage output from the reflection-type photo sensor 19 when the photo sensor checks the non-image area of the surface of the photoconductor excluding the toner adhesion pattern. Meanwhile, Vsp indicates an output voltage output from the reflection-type photo sensor 19 when the photo sensor checks the image area including the toner adhesion pattern. When Vsg0 indicates a Vsp/Vsg target value, if a value calculated by subtracting Vsg0 from the Vsp/Vsg value is not smaller than −0.07, for example (NO in Step S214), it is then determined whether the calculated value is larger than 0.07 (Step S215). If the calculated value is not larger than 0.07 (NO in Step S215), a Vsg change rate dVsg is calculated from accumulated past data of Vsg, which includes the last 64 Vsg data values (Step S216). In Step S216, the older data values are deleted first.

On the other hand, if the value calculated by subtracting Vsg0 from Vsp/Vsg is smaller than −0.07, for example (YES in Step S214), the toner density target value Vt0 is increased by 0.1 (Step S217). Further, if the calculated value is larger than 0.07, for example (YES in Step S215), the toner density target value Vt0 is decreased by 0.1 (Step S218), and the operation flow advances to Step S216.

In Phase PH4 (i.e., control of photoconductor surface potential), in each of the image forming units 1Y, 1C, 1M, and 1K, a charging voltage lower than a charging voltage used in a normal image forming operation is applied to the corresponding photoconductor 3Y, 3C, 3M, and 3K. Then, the corresponding reflection-type photo sensor 19 checks the non-image area of the surface of the transfer belt 2, to which the toner adhesion patterns have been transferred, to detect stains. Based on a result of the detection, a feedback operation is performed to maintain the charging voltage at an appropriate level. The photoconductor surface potential is changed due to scratches formed on the photoconductor and deterioration in sensitivity of the photoconductor, which are caused over time or by environmental factors. Therefore, this phase can be sequentially performed.

In Phase PH5, development potential is controlled. The development potential refers to a difference between a potential of the charged surface of the photoconductor and a development bias voltage VB applied to a development roller included in the developing unit. In each of the image forming units 1Y, 1C, 1M, and 1K, levels of an LD (laser diode) power and the charging voltage are fixed, while the development bias voltage VB is changed at multi-steps. Accordingly, a plurality of toner adhesion patterns of different toner adhesion amounts are formed, and the development bias voltage VB is adjusted such that the toner adhesion amount detected by the reflection-type photo sensor 19 becomes a target value.

Figures 6, 6A, 6B:
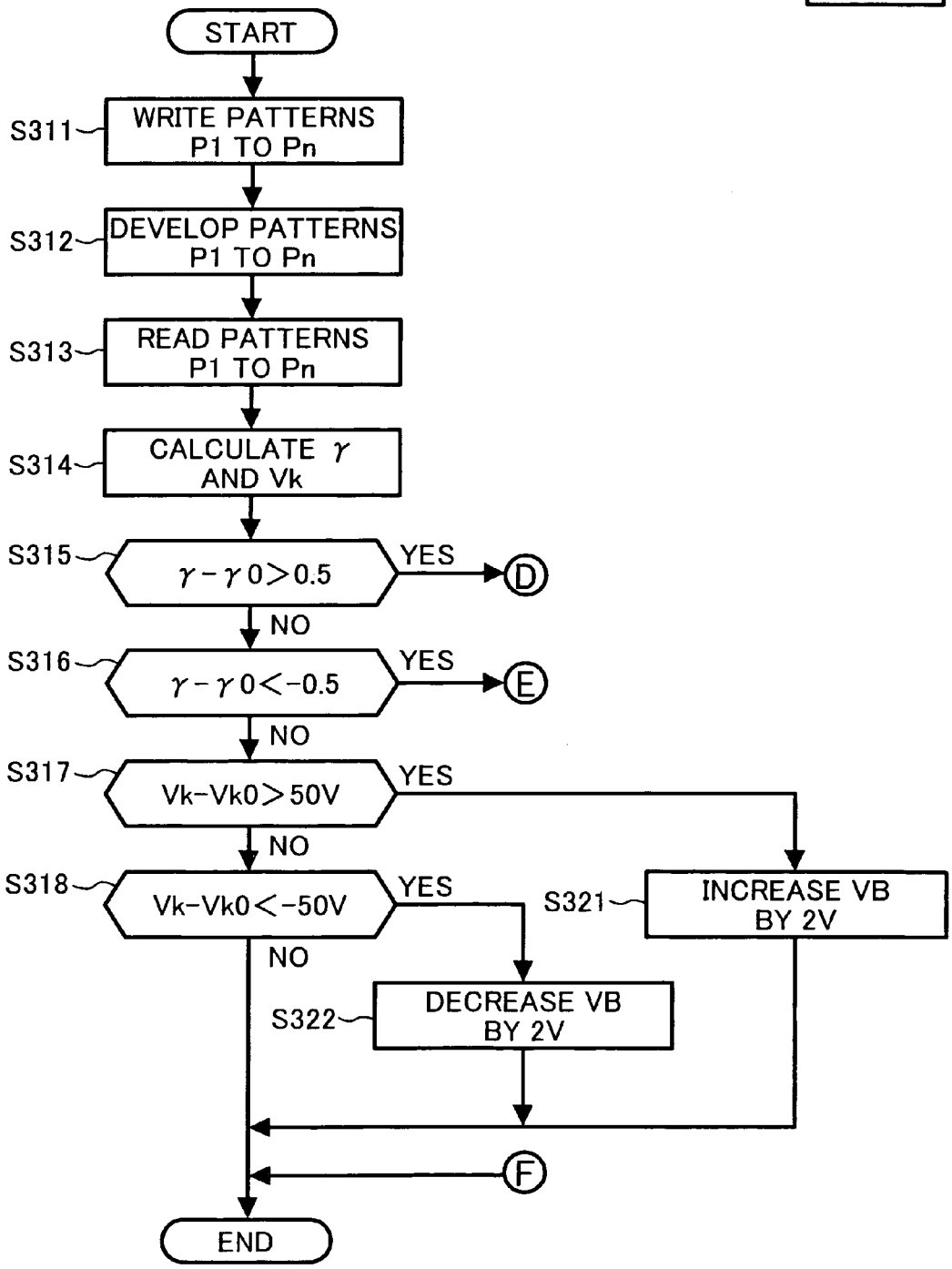
FIGS. 6A and 6B depict a flowchart illustrating an operation of controlling development potential.
Figure 6B:
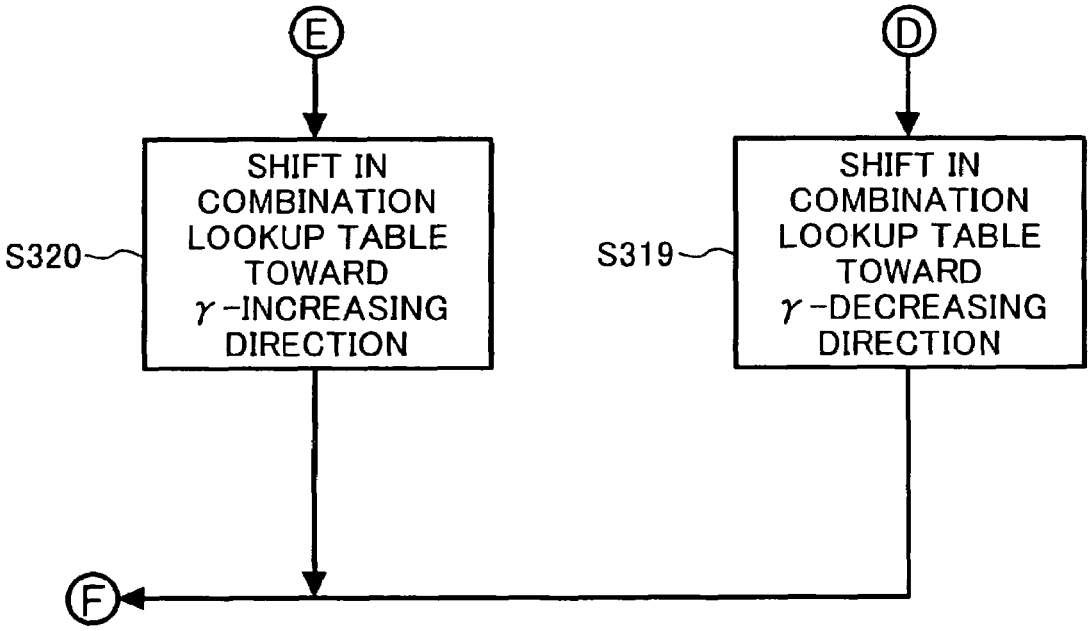

An operation flow of Phase PH5 is described with reference to the flowchart shown in FIGS. 6A and 6B. In each of the image forming units 1Y, 1C, 1M, and 1K, a plurality of toner adhesion patterns P1 to Pn (n indicates a positive integer number larger than 1) are first formed on the corresponding photoconductor 3Y, 3C, 3M, or 3K (Step S311). Then, the plurality of toner adhesion patterns P1 to Pn are developed (Step S312), and data thereof is read (Step S313). Based on the data, a development performance value γ (gamma) and a development starting voltage Vk are calculated (Step S314). If a value obtained by subtracting a γ target value γ0 from the above calculated value γ is not larger than 0.5, for example (NO in Step S315), it is then determined whether the obtained value is smaller than −0.5, for example (Step S316). If the obtained value is not smaller than −0.5, for example (NO in Step S316), it is then determined whether a value obtained by subtracting a Vk target value Vk0 from the calculated development starting voltage Vk is larger than 50 volts, for example (Step S317). If the obtained value is not larger than 50 volts, for example (NO in Step S317), it is then determined whether the obtained value is smaller than −50 volts, for example (Step S318). If the obtained value is not smaller than −50 volts, for example (NO in Step S318), the operation flow ends.

On the other hand, if the value obtained by subtracting γ0 from γ is larger than 0.5, for example (YES in Step S315), a shift is made toward a γ-decreasing direction in a combination lookup table which includes patterns of combination among a light amount, the development bias voltage, and a charging bias voltage (Step S319). Further, if the obtained value is smaller than −0.5, for example (YES in Step S316), a shift is made toward a γ-increasing direction in the combination lookup table (Step S320). Furthermore, if the value obtained by subtracting Vk0 from Vk is larger than 50 volts, for example (YES in Step S317), the development bias voltage VB is increased by 2 volts (Step S321). If the obtained value is smaller than −50 volts, for example (YES in Step S318), the development bias voltage VB is decreased by 2 volts (Step S322).

In Phase PH6, adjustment of halftone is performed. In each of the image forming units 1Y, 1C, 1M, and 1K, a predetermined development bias voltage VB and a predetermined charging voltage are output, and a plurality of toner adhesion patterns are formed on the corresponding photoconductor 3Y, 3C, 3M, or 3K with different LD powers. Then, the corresponding reflection-type photo sensor 19 checks the plurality of toner adhesion patterns. A development characteristic (i.e., development performance γ) is then obtained from the output voltage output from the reflection-type photo sensor 19, and the LD power is adjusted so that the development characteristic takes a target value.

In Phase PH7 (i.e., control of write positions), color images are aligned to prevent the color images from being displaced. Phase PH7 is formed by four executable units, i.e., skew adjustment (FIG. 7A), alignment in a sub-scanning direction (FIG. 7B), alignment in a main-scanning direction (FIG. 7C), and control for preventing magnification deviation (FIG. 7D). Operation flow of each of the four executable units is described below with reference to FIGS. 7A to 7D.

Figure 7A:
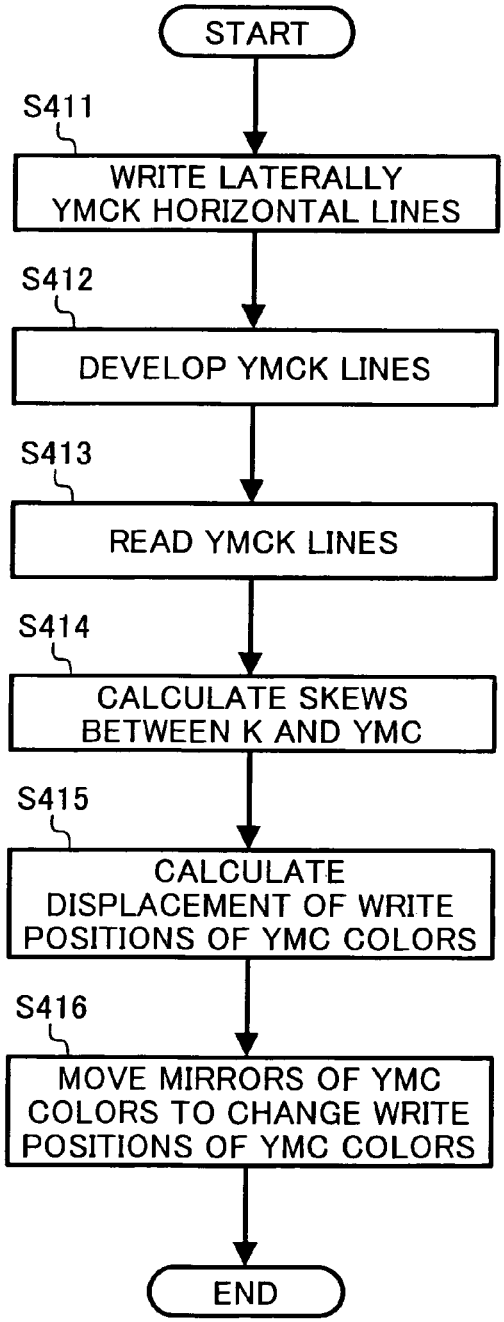
FIGS. 7A to 7D are flowcharts illustrating an operation of controlling write positions.

In the skew adjustment shown in FIG. 7A, horizontal lines (i.e., lines extending in the main-scanning direction) of YMCK colors are written laterally (i.e., in a rotation direction of the transfer belt 2) on each of the photoconductors 3Y, 3M, 3C and 3K (Step S411). Then, the horizontal lines of YMCK colors are developed (Step S412), and data thereof is read (Step S413). Based on the data, a skew between K and each of Y, M, and C is calculated (Step S414), and displacement of write position is calculated for each of the YMC colors (Step S415). Then, mirrors provided for the respective YMC colors are moved to adjust the write positions of the YMC colors (Step S416).

Figure 7B:
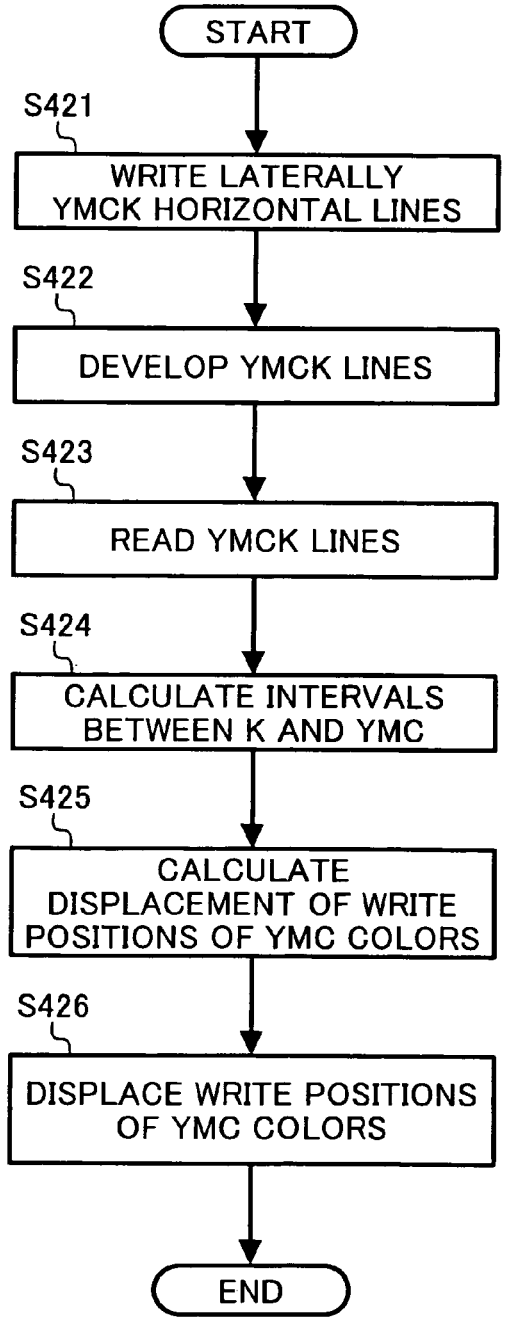

In the alignment in the sub-scanning direction shown in FIG. 7B, the horizontal lines of YMCK colors are written laterally on each of the photoconductors 3Y, 3M, 3C and 3K (Step S421). Then, the horizontal lines of YMCK colors are developed (Step S422), and data thereof is read (Step S423). Based on the data, an interval between K and each of Y, M, and C is calculated (Step S424), and displacement of write position is calculated for each of the YMC colors (Step S425). Then, the write positions of the YMC colors are adjusted (Step S426).

Figure 7C:
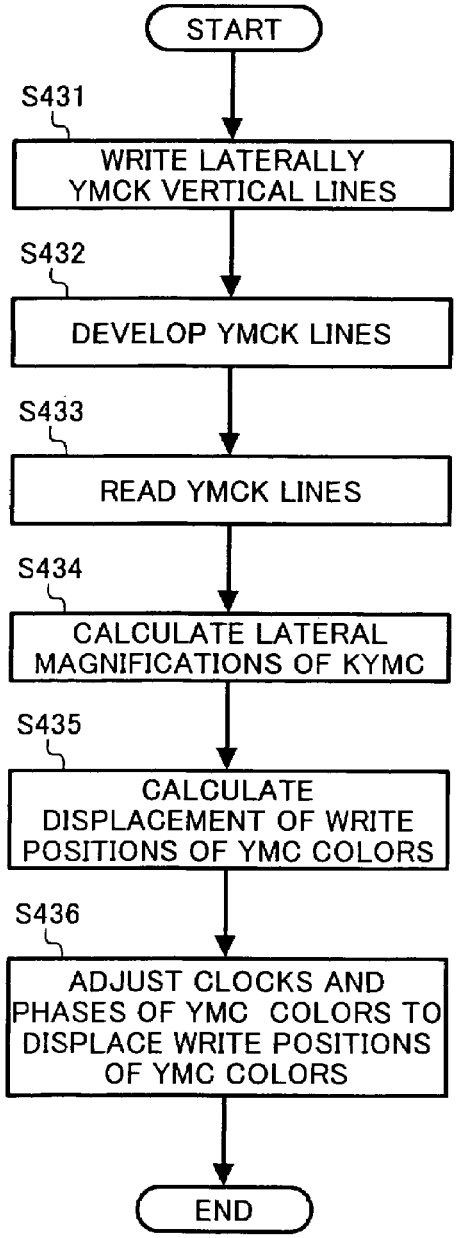
Figure 7D:
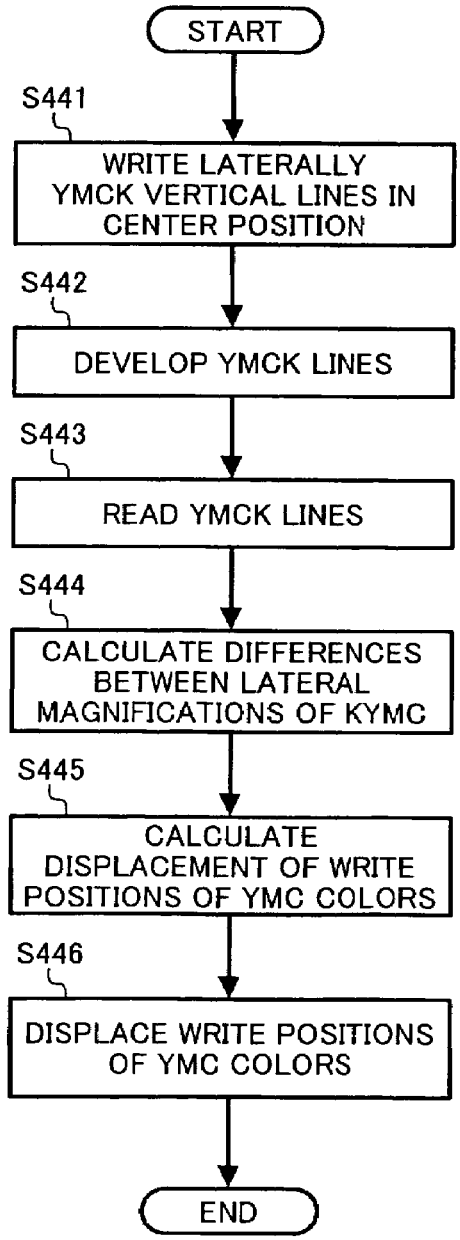

In the alignment in the main-scanning direction shown in FIG. 7C, vertical lines (i.e., lines extending in the sub-scanning direction) of YMCK colors are written laterally on each of the photoconductors 3Y, 3M, 3C and 3K (Step S431). Then, the vertical lines of YMCK colors are developed (Step S432), and data thereof is read (Step S433). Based on the data, lateral magnification is calculated for each of KYCM colors (Step S434), and displacement of write position is calculated for each of the YMC colors (Step S435). Then, a clock and a phase are adjusted for each of the YMC colors to adjust the write positions of the YMC colors (Step S436).

In the control for preventing the magnification deviation shown in FIG. 7D, the vertical lines of YMCK colors are written laterally on each of the photoconductors 3Y, 3M, 3C and 3K in the center position (Step S441). Then, the vertical lines of YMCK colors are developed (Step S442), and data thereof is read (Step S443). Based on the data, differences among lateral magnifications of the KYMC colors are calculated (Step S444), and displacement of write position is calculated for each of the YMC colors (Step S445). Then, the write positions of the YMC colors are adjusted (Step S446).

In Phase PH8 (i.e., mixing of development agent), a mixing member provided in each of the developing units 6Y, 6M, 6C, and 6K is driven to rotate for mixing the development agent. Accordingly, as in Phase PH2 described above, when the amount of charged toner has decreased after elapse of a relatively long time since the last use of the image forming apparatus, the amount of charged toner can be increased by performing this phase.

A relatively long time is taken for each of Phases PH5 and PH6, wherein ten toner adhesion patterns of different toner adhesion amounts are formed. The toner adhesion patterns are formed in areas of the surfaces of the photoconductors 3Y, 3C, 3M, and 3K in which toner images are not formed in the normal image forming operation. Then, the toner adhesion patterns are transferred to the transfer belt 2. Thereafter, each of the four reflection-type photo sensors 19 provided at a downstream side of the second transfer stage (i.e., the second transferring unit 15) detects a reflected light amount to measure the toner adhesion amount. When this detection is performed, the second transferring unit 15 should be separate from the transfer belt 2 so as not to deform the toner adhesion patterns formed on the transfer belt 2.

In the image forming apparatus 100 of FIG. 2, in order to perform the detection of the toner adhesion patterns of the four colors K, M, C, and Y in as a short time as possible, the four reflection-type photo sensors 19 are provided at the downstream side of the second transferring unit 15 in a crosswise direction of the transfer belt 2 such that the four reflection-type photo sensors 19 face the surface of the transfer belt 2. Thus arranged, the four reflection-type photo sensors 19 can concurrently perform the detection operation while being protected from scattered toner.

Phases PH4 and PH5 are performed to optimize the development potential of each of the image area and non-image area on the surfaces of the photoconductors 3Y, 3M, 3C, and 3K. It is desirable to perform the two phases around the same time. If the two phases are sequentially performed, however, a relatively long time is taken to complete the entire condition control.

A condition control according to an embodiment of the present invention is described with reference to FIG. 8. The flowchart of FIG. 8 illustrates an operation flow to be followed when an image output signal is received during the condition control, particularly in a case where the image output operation is completed in a relatively short time and thus interruption of the image output operation by the condition control is unnecessary.

Figure 8:
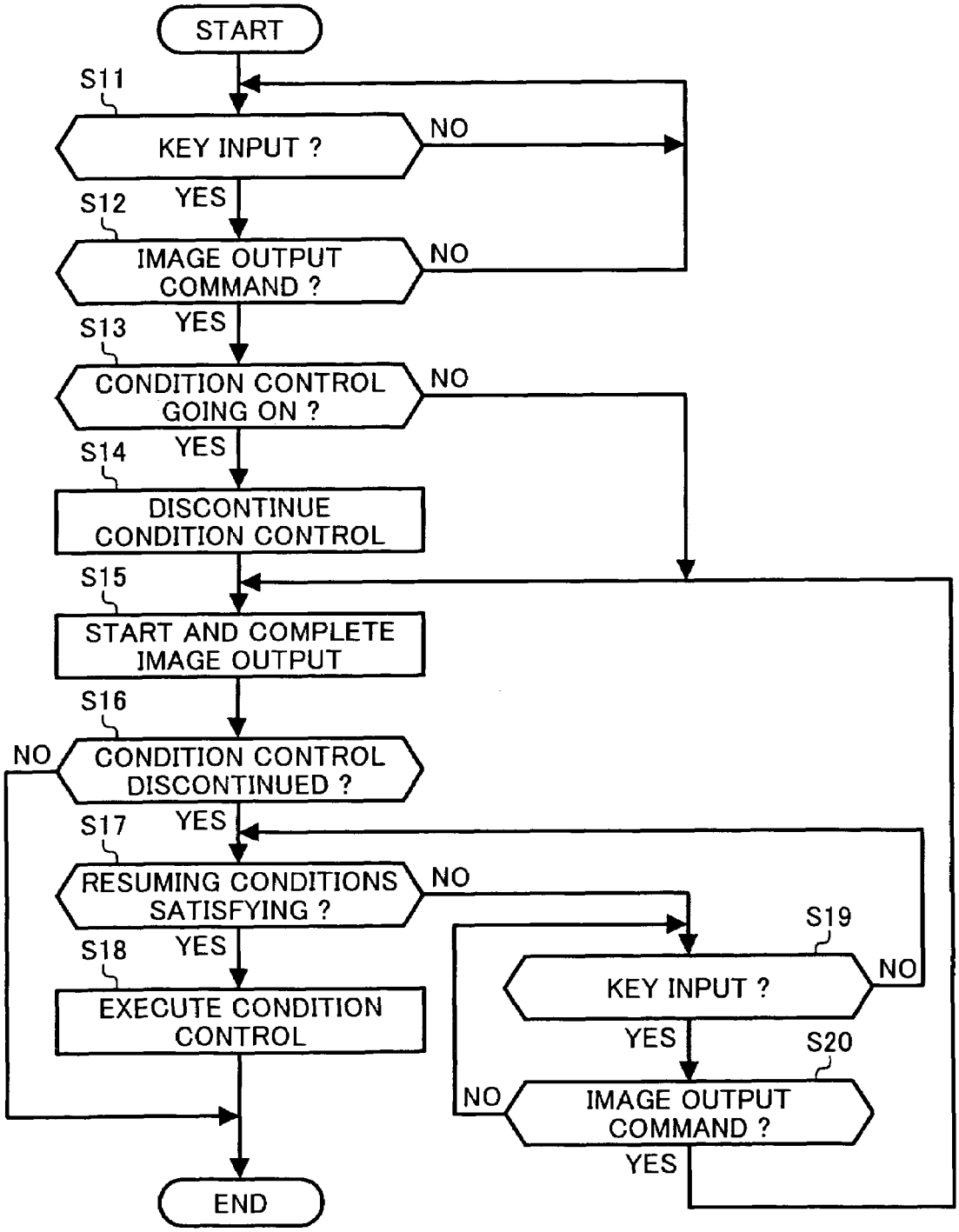
FIG. 8 is a flowchart for explaining a relationship between the condition control according to an embodiment of the present invention and an image output operation.

In the flowchart of FIG. 8, it is first determined whether any data is received from an external device or the scanning unit of the image forming apparatus 100 (Step S11). This step is simplistically described as "KEY INPUT?" in the flowchart. If any data is received (YES in Step S11), it is then determined whether the data includes an image output command (Step S12). If the data includes the image output command (YES in Step S12), it is determined whether the condition control is going on (Step S13). If the condition control is going on (YES in Step S13), the condition control is discontinued (Step S14), and the image output operation is immediately performed (Step S15). If the condition control is still discontinued when the image output operation has been completed (YES in Step S16), it is determined whether conditions for resuming the condition control are met (Step S17). If the conditions are met (YES in Step S17), the condition control is resumed (Step S18), and the operation flow ends. If the conditions for resuming the condition control are not met (NO in Step S17), monitoring continues to determine if the image output signal is sent (Steps S19 and S20) until the conditions are met. If the image output signal is sent (YES in Step S20), the operation flow returns to Step S15 to perform the image output operation.

In this embodiment, monitoring to detect a next image output command is not performed during execution of the resumed condition control at Step S118. That is, according to the embodiment, the once discontinued condition control is not discontinued again before completion thereof, so that interruption of the condition control by any other operation is not allowed.

Conditions for not resuming the condition control include, for example, a situation in which immediate resumption of the condition control should be avoided since another image output command is immediately received, a user is inputting another image output command, or it is highly possible that another image output command is immediately issued. Operations to be followed in these situations are later described in detail. If it is preferable to unconditionally resume the condition control, however, Step S17 may be omitted to directly proceed to Step S18. In the flowchart of FIG. 8, when the operation flow finishes at END, the operation flow returns to START to detect data input.

Timing of performing the condition control is described below. The temperature sensor 16*a* provided in contact with the fixing unit 16 is constantly in an operating condition to detect a temperature of the fixing unit 16 while the image forming apparatus 100 is in an ON state. If the temperature detected by the temperature sensor 16*a* is equal to or lower than approximately 50 degrees centigrade, for example, immediately after power-on of the image forming apparatus 100, it is determined that sufficient time has elapsed since the last power-off of the image forming apparatus 100. After that, a fixing temperature is increased to prepare for the image forming operation, and readjustment is made for output conditions of the image forming units 1Y, 1C, 1M, and 1K, such as a charging grid voltage, the LD power, and the development bias voltage. During this warm-up operation in which the image forming apparatus 100 is powered on and the temperature detected by the temperature sensor 16*a* is equal to or lower than approximately 50 degrees centigrade, for example, a series of Phases PH1 to PH8 forming the condition control are performed. Normally, an image output request is not accepted during this operation. The fixing unit 16 is warmed up to a predetermined temperature by performing an ON/OFF control of a heater provided therein (not shown).

In addition to the timing described above, the condition control may be also performed at other times, such as immediately after completion of the normal image output operation and at a time preset by a timer (not shown) provided in the image forming apparatus 100. Further, the condition control is not necessarily executed immediately after every image output operation. For example, the control of photoconductor surface potential performed in Phase PH4 follows after completion of a job during which the number of output sheets accumulated since the last performance of Phase PH4 amounts to or exceeds one thousand, for example. On completion of the Phase PH4, counting of the accumulated number of output sheets is reset. Further, if the number of sheets to be consecutively output in one job is relatively large, the image quality may change during execution of the job. Therefore, when one hundred sheets, for example, have been consecutively output during a consecutive job, Phase PH2 (i.e., setting of a toner density control reference value), for example, interrupts and forcefully discontinues the job. Thereafter, to stabilize the image quality, the toner adhesion patterns are formed on the surface of the transfer belt 2 and checked by the reflection-type photo sensors 19. Then, the control reference value of the toner density sensor is adjusted in accordance with the output voltages output from the reflection-type photo sensors 19 that have checked the toner adhesion patterns.

Another embodiment of the condition control is described with reference to FIGS. 9 and 10. The table of FIG. 9 indicates an example of execution time, execution timing, priority order based on execution time length, and priority order based on execution frequency, all of which are set for each of the eight phases forming the condition control. In this table, a priority order A is based on the execution time length of each phase (i.e., time required for performing each phase), and higher priority is given to a phase completed in a shorter time. A priority order B, on the other hand, is based on the execution frequency of each phase, and higher priority is given to a phase performed more frequently. Furthermore, in this table, Phases PH1 and PH8 are not given any priority orders for the following reasons. First, Phase PH1 is not performed at other timing than upon power-on of the image forming apparatus 100, while the other phases are performed upon power-on of the image forming apparatus 100 and at another timing. Further, Phase PH8 needs not to be performed during the job, since a developing operation performed in the job already includes mixing of the development agent.

An exemplary pattern of the condition control according to the present embodiment is illustrated in the diagram of FIG. 10. In this case, it is assumed that the condition control is performed after the image output operation, and the accumulated number of output sheets counted since the last performance of Phases PH4 and PH5 in the previous condition control amounts to at least one thousand during the condition control. In this case, the phases to be performed in the condition control are Phase PH4 (control of photoconductor surface potential), Phase PH5 (control of development potential), Phase PH2 (setting of a toner density control reference value), Phase PH3 (control of toner supply), and Phase PH7 (control of write positions). If the five phases are serially performed, time required for completing the five phases totals thirty-six seconds.

In the present embodiment shown in FIG. 10, the phases are performed in accordance with the priority order B indicated in the table of FIG. 9, i.e., in order of execution frequency. As illustrated in the diagram of FIG. 10, the five phases are executed in an order of Phase PH3 (control of toner supply), Phase PH2 (setting of a toner density control reference value), Phase PH7 (control of write positions), Phase PH4 (control of photoconductor surface potential), and Phase PH5 (control of development potential). According to this execution order, phases which should be frequently performed are preferentially performed. Therefore, even if an ongoing condition control is discontinued upon receipt of the image output signal, it is possible to reduce possibility that the phases which should be frequently performed are postponed until after the image output operation. Further, when a phase of relatively low frequency is originally scheduled to be performed after a job of at least 1000 sheets, for example, but actually performed after output of 1010 sheets, for example, serious affect is not caused on maintenance of the image quality.

When a plurality of phases are given equal priority in the order of execution frequency, the time required for performing each of the phases is taken into consideration. That is, a phase performed in a shorter time is performed first. In the above embodiment of FIG. 10, Phase PH4 (control of photoconductor surface potential) and Phase PH5 (control of development potential) are given equal priority in the order of execution frequency. That is, both of Phases PH4 and PH5 are performed after a job of at least 1000 sheets. However, Phase PH4 takes a shorter time (5 seconds) than Phase PH5 does (10 seconds), and thus Phase PH4 is performed more preferentially than Phase PH5. Accordingly, as many phases as possible can be completed in a relatively short time period. Further, even if the ongoing condition control is discontinued upon receipt of the image output signal, the number of phases to be postponed for the next condition control can be reduced.

In determining execution priorities of the phases in the present embodiment, the execution frequency is given priority over the execution time. That is, the priority order B is given priority over the priority order A. Therefore, as illustrated in the diagram of FIG. 10, even if Phase PH4 (control of photoconductor surface potential) takes a shorter time than Phase PH2 (setting of a toner density control reference value) does, Phase PH2 is performed prior to Phase PH4.

Another embodiment of the condition control is described with reference to FIGS. 11 and 12A to 12E. The table of FIG. 11 indicates another example of execution time, execution timing, priority order based on execution time, and priority order based on execution frequency, all of which are set for each of the eight phases forming the condition control. Exemplary patterns of the condition control according to the present embodiment are illustrated in FIGS. 12A to 12E.

Each of the eight phases is performed upon power-on of the image forming apparatus 100.

Figure 12A:
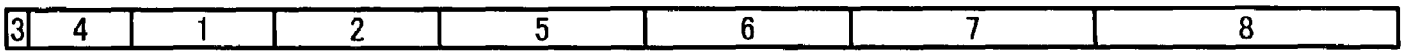
FIGS. 12A to 12E are diagrams illustrating condition control patterns according to another embodiment of the present invention.

FIG. 12A illustrates a phase execution order to be followed when all of the eight phases are performed upon power-on of the mage forming apparatus 100.

In this embodiment, the phases are performed in accordance with the priority order C of FIG. 11, i.e., in order of the execution time length from the shortest to the longest. When all of the eight phases are serially performed, time required for completing the eight phases totals sixty-eight seconds.

Figure 12B:
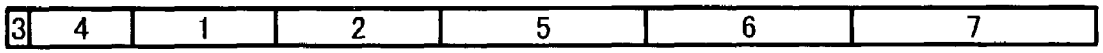

FIG. 12B illustrates a phase execution order to be followed when the condition control is performed without being discontinued after completion of a job during which the accumulated number of output sheets has amounted to two thousands, for example. When seven phases excluding Phase PH8 (mixing of development agent) are serially performed, time required for completing the seven phases totals fifty-three seconds.

Figure 12C:
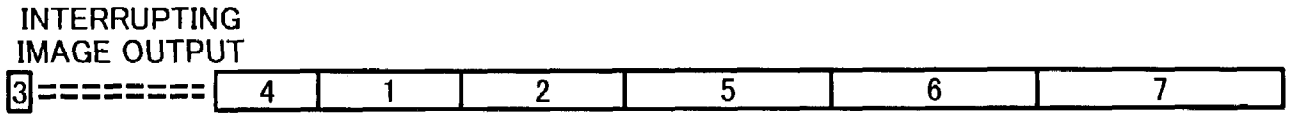

FIG. 12C illustrates a phase execution order to be followed when the job interrupts the condition control performed in the phase execution order shown in FIG. 12B, wherein the interrupting job is performed after Phase PH3. In this case, when the discontinued condition control is resumed, remaining phases are performed in an initially set execution order.

Figure 12D:
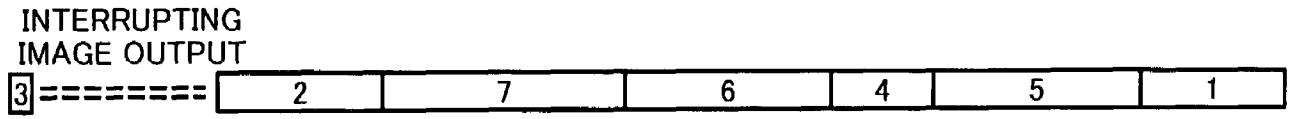

FIG. 12D illustrates another phase execution order to be followed when the job interrupts the condition control performed in the phase execution order shown in FIG. 12B, wherein the interrupting job is performed after Phase PH3. In this case, when the discontinued condition control is resumed, the remaining phases are performed in accordance with the priority order D of FIG. 11, i.e., in order of execution frequency from the highest to the lowest.

Figure 12E:
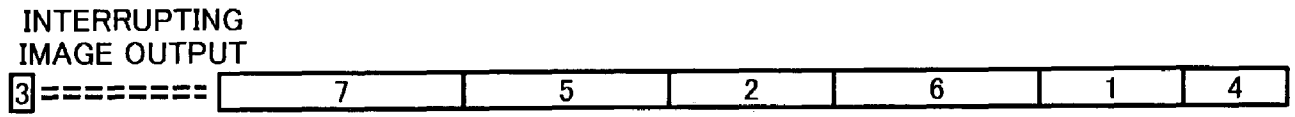

FIG. 12E is still another phase execution order to be followed when the job interrupts the condition control performed in the phase execution order shown in FIG. 12B, wherein the interrupting job is performed after Phase PH3. In this case, when the discontinued condition control is resumed, the remaining phases are performed in order of discontinuation frequency. The execution order of the remaining phases is determined case by case.

If the position of the interrupting image output operation in the phase execution order is changed, the execution order of the remaining phases to be performed in the resumed condition control is also changed, since already performed phases are not performed again. In the above example of FIG. 12A, the phases are performed in order of execution time length from the shortest to the longest. If the phases are performed in order of execution frequency from the highest to the lowest, the remaining phases to be performed in the resumed condition control can be reordered in similar manners as described above.

As described above, when the condition control is discontinued, priority orders can be newly assigned to the remaining phases to be performed after resumption of the discontinued condition control. Accordingly, even if the resumed condition control is discontinued again, discontinuation of a particular phase of the condition control can be prevented.

Although not illustrated in FIGS. 12A to 12E, such phases as Phase PH8 (i.e., mixing of development agent) which is not normally performed after the job, do not necessarily follow or precede another phase of the condition control. That is, if necessary, such phases can be started during Phase PH1 (i.e., initial setting of the reflection-type photo sensors), for example, to proceed concurrently with Phase PH1. Therefore, by concurrently performing more than one phase which do not interfere one another, an operation time taken for the whole process of the condition control can be shortened.

Another embodiment of the condition control is described with reference to FIG. 13. According to this embodiment, when the image output command is received during the condition control, the image forming apparatus 100 of FIG. 2 basically prioritizes execution of the image output operation over execution of the condition control. As an exception, however, if remaining time before completion of the condition control is five seconds or less at the time of receipt of the image output command, the condition control is completed without being discontinued. After the completion of the condition control, the image output operation, a request for which has been received, is performed.

Figure 13:
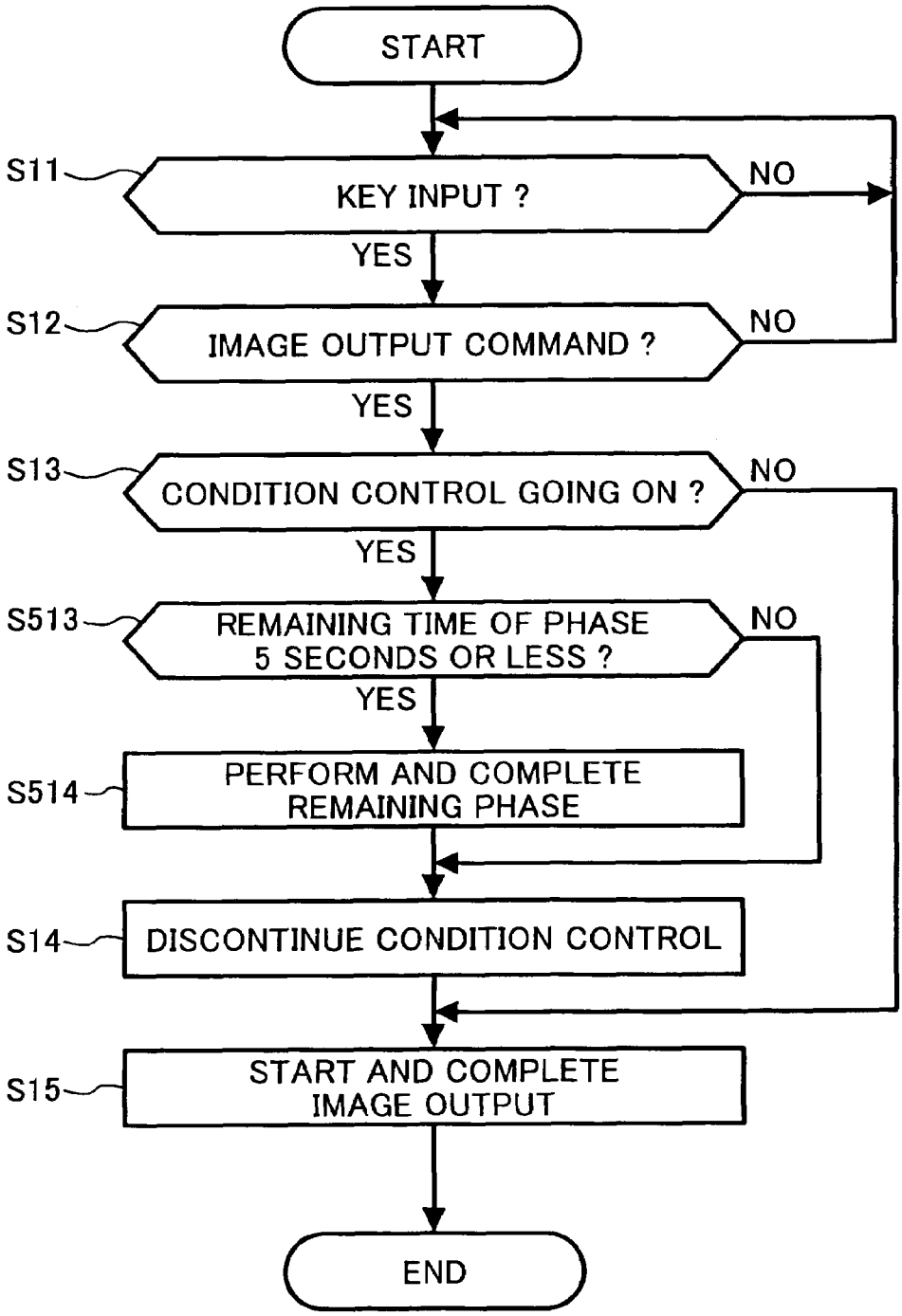
FIG. 13 is a flowchart for explaining a condition control according to another embodiment of the present invention.

In the flowchart of FIG. 13, it is determined first whether any data is received from the external device or the scanning unit of the image forming apparatus 100 (Step S11). If any data is received (YES in Step S11), it is then determined whether the data includes an image output command (Step S12). If the data includes the image output command (YES in Step S12), it is determined whether the condition control is going on (Step S13). The above steps S11 to S13 are similar to Steps S11 to S13 of FIG. 8. If the condition control is going on (YES in Step S13), and if remaining operation time (hereinafter referred to as remaining time) before completion of a particular ongoing phase of the condition control is five seconds or less (YES in Step S513), the condition control continues to be performed until the particular ongoing phase is completed (Step S514). After the particular ongoing phase is completed and the condition control is discontinued (Step S14), the image output operation is started (Step S15). If the remaining time exceeds five seconds (NO in Step S513), on the other hand, the condition control is immediately discontinued (Step S14), and the image output operation is started (Step S15). After the image output operation starts, Step S16 and the subsequent steps of FIG. 8 may follow. Data of discontinued phases such as the discontinuation frequency of each of the discontinued phases may be stored in a memory or the like, so that the data can be used as a basis for determining the execution order of phases to be performed after resumption of the discontinued condition control, as in the example of FIG. 12E.

For example, referring back to the five phases in the diagram of FIG. 10, if the image output command is received during Phase PH5 (i.e., control of development potential) at a time point a at which the remaining time is eight seconds, Phase PH5 is discontinued to perform the image output operation. On the other hand, if the image output command is received during Phase PH5 at a time point b at which the remaining time is four seconds, Phase PH5 is continued and completed, so that the image output operation is started after completion of Phase PH5. This arrangement is based on an assumption that a user of the image forming apparatus is unlikely to feel serious inconvenience toward a waiting time of five seconds. With this arrangement, the condition control is executed without interruption if the remaining time is five seconds or less, so that there is no need to re-execute the condition control from the beginning after completion of the image output operation.

The remaining time which is set to be five seconds in the above example may be changed by the process controlling unit 200 of the image forming apparatus 100. Accordingly, a user-friendly image forming apparatus allowing users to arbitrarily set the remaining time can be provided.

Figure 14:
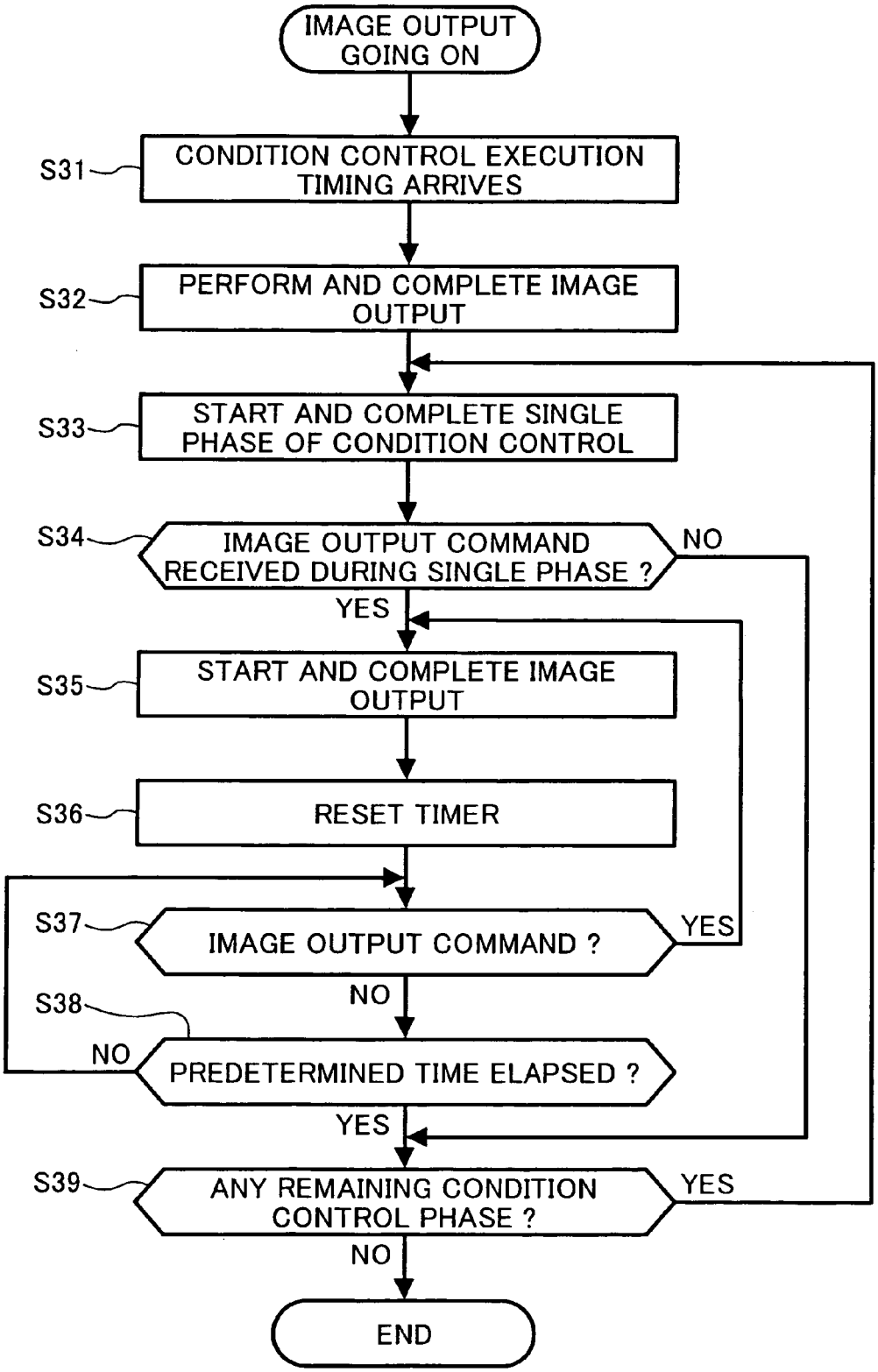
FIG. 14 is a flowchart for explaining a condition control according to another embodiment of the present invention.

Another embodiment of the condition control is described with reference to the flowchart of FIG. 14. The execution timing of the condition control is generally determined based on the number of output sheets. Therefore, the execution timing usually arrives during the image output operation. In light of this circumstance, the condition control according to the present embodiment is executed as illustrated in the flowchart of FIG. 14.

When the execution timing of the condition control arrives during the image output operation (Step S31), the image output operation is completed (Step S32), and immediately thereafter, a single phase of the condition control is performed (Step S33). If it is recognized, at the time of completion of the single phase, that a next image output command has been received during execution of the single phase (YES in Step S34), a next image output operation is started (Step S35). If the next image output command is not yet received (NO in Step S34), and if there is any remaining phase of the condition control (YES in Step S39), the operation flow returns to Step S33 to perform the remaining phase. If there is no remaining phase of the condition control (NO in Step S39), the operation flow ends. When the image output operation is completed (Step S35), the timer is reset (Step S36), and it is determined whether another image output command is received (Step S37). If the another image output command is received (YES in Step S37), the operation flow returns to Step S35 to perform the image output operation. If the another image output command is not received (NO in Step S37), and if a predetermined time set on the timer has not elapsed yet (NO in Step S38), the operation flow returns to Step S37 to determine whether another image output command is received. If the predetermined time set on the timer has elapsed (YES in Step S38), it is determined whether there is any remaining phase of the condition control (Step S39). If there is no remaining phase of the condition control (NO in Step S39), the operation flow ends.

Figures 15, 15A, 15B:
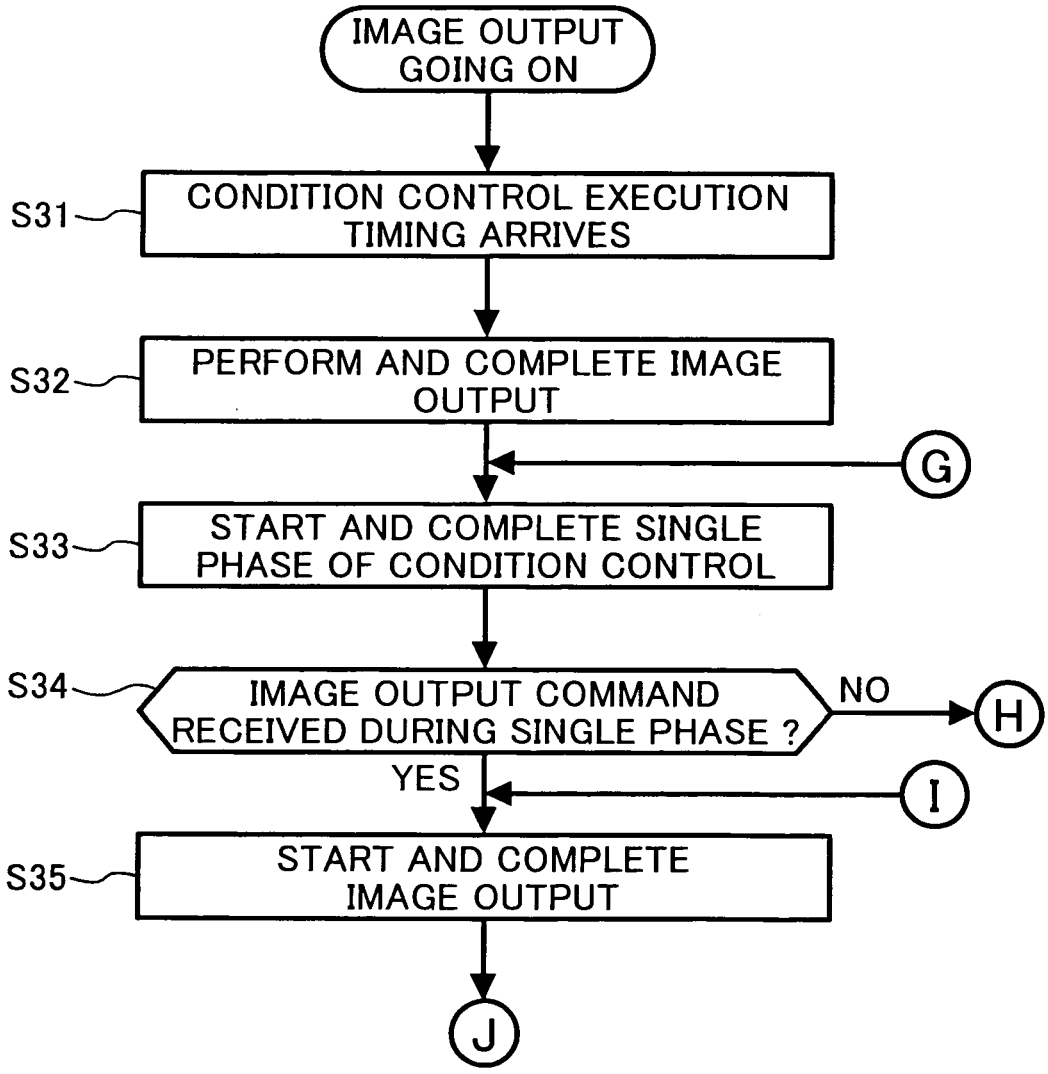
FIGS. 15A and 15B depict a flowchart for explaining a condition control according to another embodiment of the present invention.
Figure 15B:
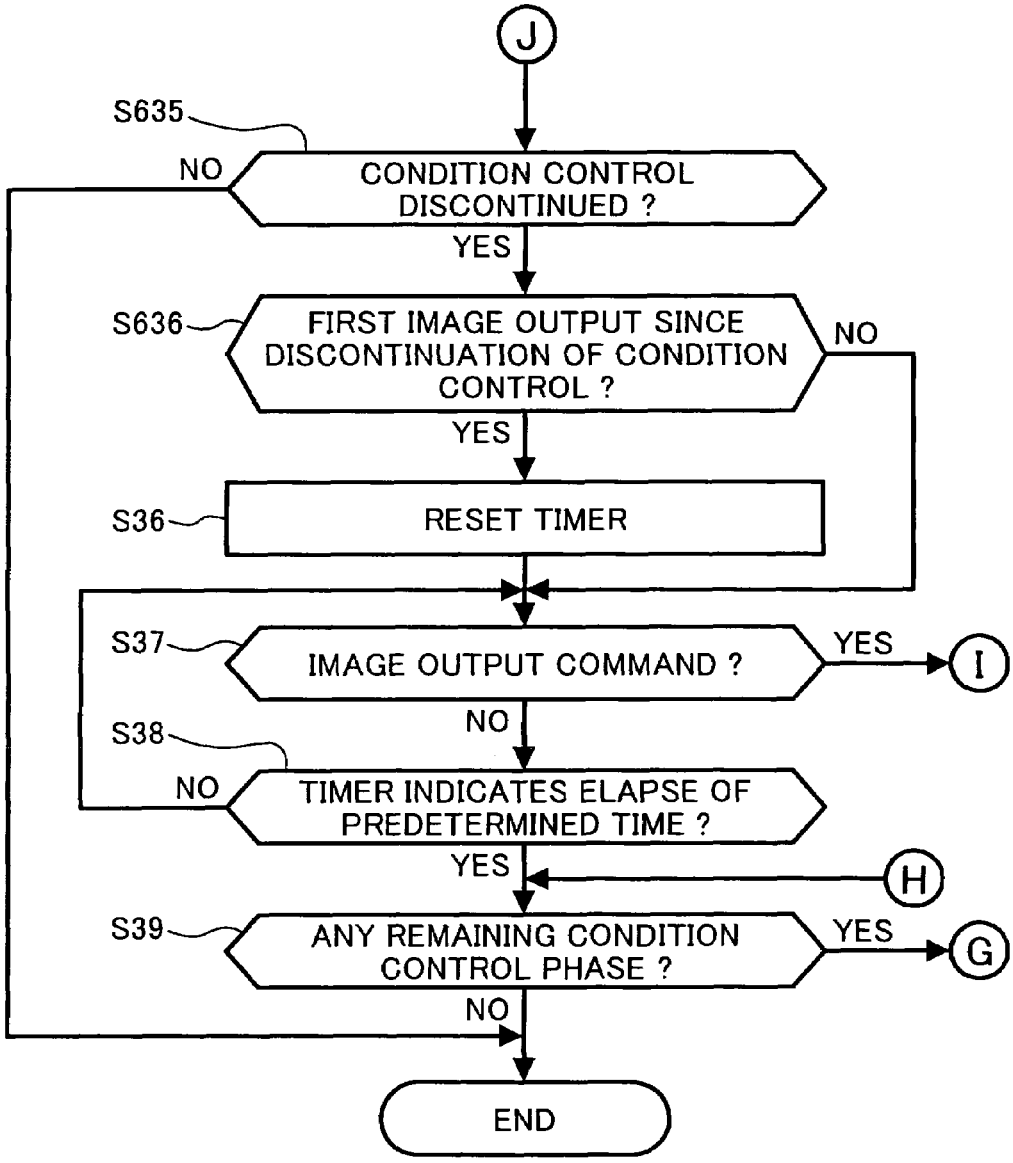

Another embodiment of the condition control is described with reference to the flowchart shown in FIGS. 15A and 15B. The present embodiment is a modification of the previous embodiment illustrated in FIG. 14. The flowchart of FIGS. 15A and 15B is different from the flowchart of FIG. 14 in that the resetting of the timer (Step S36) is not performed unconditionally but performed if the condition control is discontinued (Step S635) and the image output operation is performed for the first time since discontinuation of the condition control (YES in Step S636). That is, Steps S635 and S636 are additionally included so that a determination is made not to reset the timer in the second and subsequent image output operations. Accordingly, even when a series of image output commands are received after discontinuation of the condition control, if a predetermined time has elapsed since completion of the first image output operation started after discontinuation of the condition control, the condition control can be resumed. If the image output operation is going on when the predetermined time has elapsed, the condition control can be resumed after completion of the image output operation. Accordingly, serious deterioration in image quality can be prevented.

Figures 16, 16A, 16B:
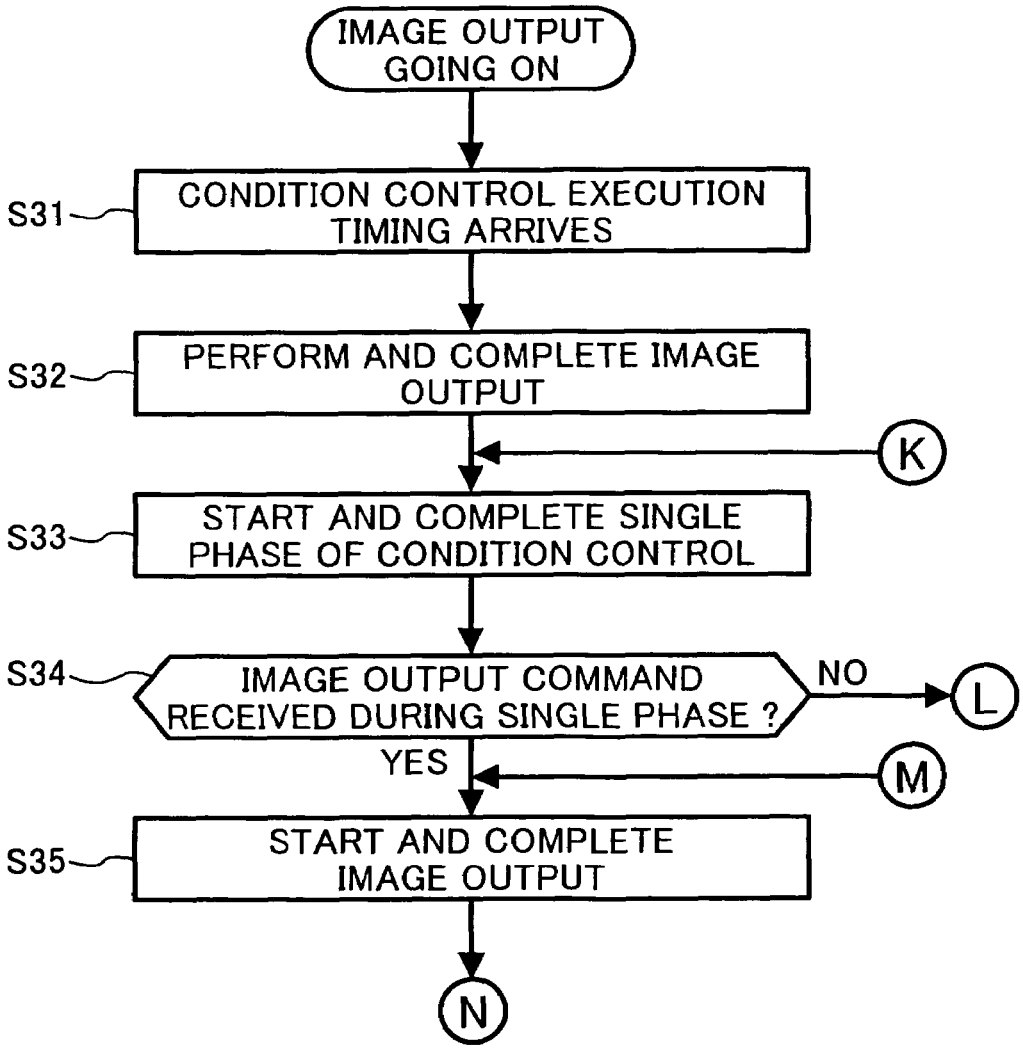
FIGS. 16A and 16B depict a flowchart for explaining a condition control according to another embodiment of the present invention.
Figure 16B:
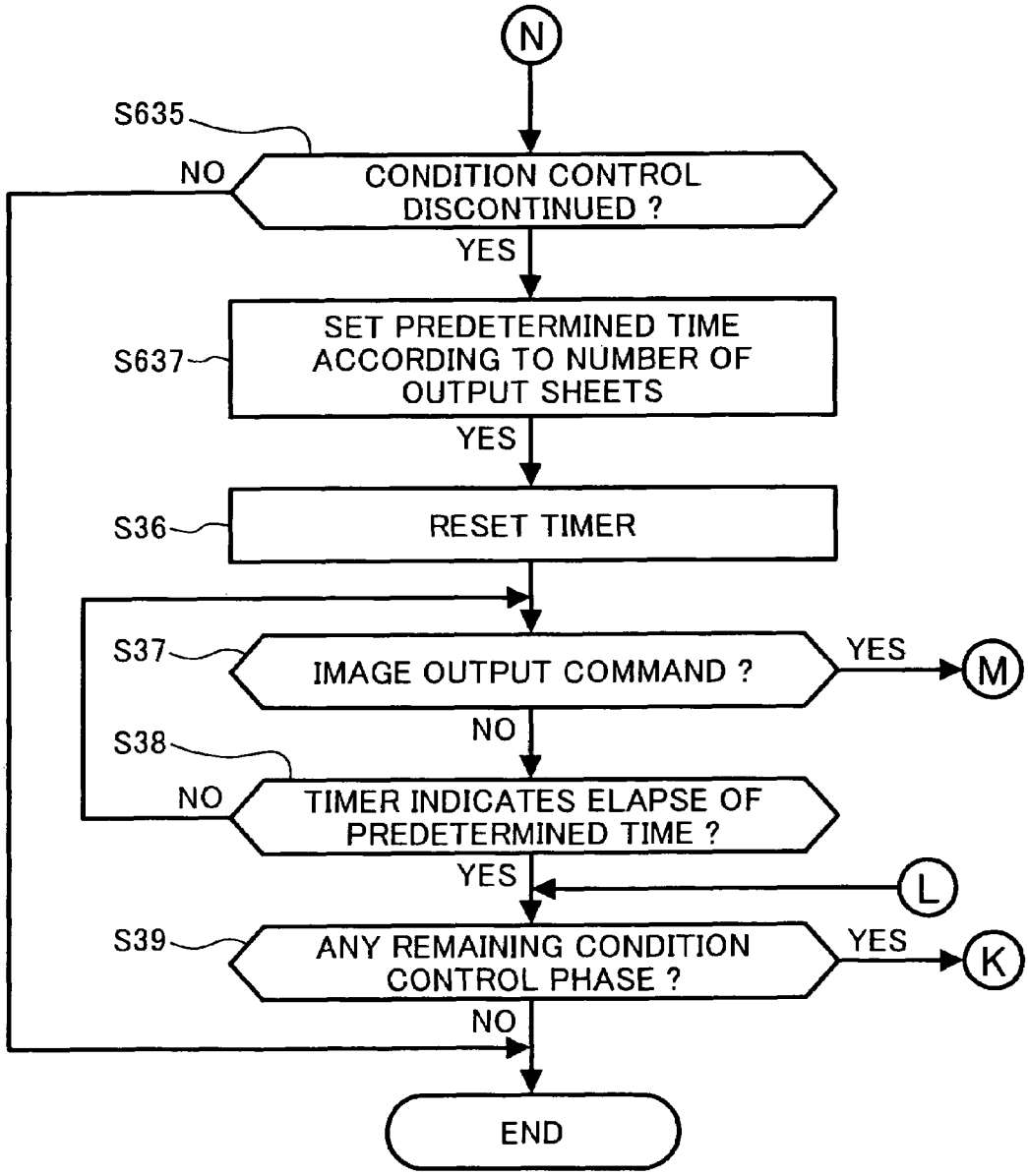

Another embodiment of the condition control is described with reference to the flowchart shown in FIGS. 16A and 16B. The present embodiment is another modification of the embodiment illustrated in the flowchart of FIG. 14. In the present embodiment, when the image output operation is completed (Step S35), and if the condition control is not discontinued (NO in Step S635), the operation flow ends. If the condition control is discontinued (YES in Step S635), the number of output sheets is counted and a predetermined time is set in accordance with the counted number (Step S637). Further, the timer is reset (Step S36), and it is determined whether the image output command is received (Step S37) and whether the predetermined time set on the timer has elapsed (Step S38). If the image output command is not received (NO in Step S37), and if the predetermined time set on the timer has elapsed (YES in Step S38), it is determined whether there is any remaining phase of the condition control (Step S39). If there is any remaining phase of the condition control (YES in Step S39), the operation flow returns to Step S33 to perform the remaining phase. If there is no remaining phase of the condition control (NO in Step S39), the operation flow ends.

Correspondence between the number of output sheets and the predetermined time set on the timer may be determined by using a correspondence table included previously in the memory, or by individually calculating the number of output sheets through a certain function and then calculating the predetermined time.

Generally, a new image output command tends to be issued immediately after output of a relatively small number of sheets. This tendency is reduced after output of a relatively large number of sheets, since extra time is required for fetching the sheets output from the image forming apparatus and for confirming contents of the output sheets, for example. Therefore, the predetermined time may be set to be ten seconds, for example, if the number of output sheets is one, while the predetermined time may be set to be five seconds, for example, if the number of output sheets is ten. Further, the predetermined time may be set to be zero, for example, if the number of output sheets exceeds twenty. It is possible to preset patterns of the correspondence between the number of output sheets and the predetermined time set on the timer and include in the memory a lookup table for the correspondence patterns so that a user can use the fixed values of the table. It is also possible to allow the user to arbitrarily set values of the table.

Another embodiment of the condition control is described with reference to the flowchart of FIG. 17. As described above, the execution timing of the condition control is determined based on the predetermined number of output sheets. Therefore, the execution timing of the condition control arrives during the image output operation. Usually, execution of the image output operation is given priority over execution of the condition control, so that the control condition is not immediately performed but suspended until the image output operation is completed.

If the number of sheets output in the image output operation is relatively large, however, any of the image forming process conditions may be deteriorated during a waiting time for completion of the image output operation. As a result, the image forming process condition may reach an allowable limit, causing serious damage on the image quality. For this reason, the present embodiment is designed such that the image output operation is interrupted by the condition control, if necessary, to preferentially perform the condition control, when it is recognized that one of the image forming process conditions has reached the allowable limit, and thus a phase of the condition control should be performed for improving the image forming process condition. Such phase of the condition control is hereinafter referred to as a limitation phase.

Figure 17:
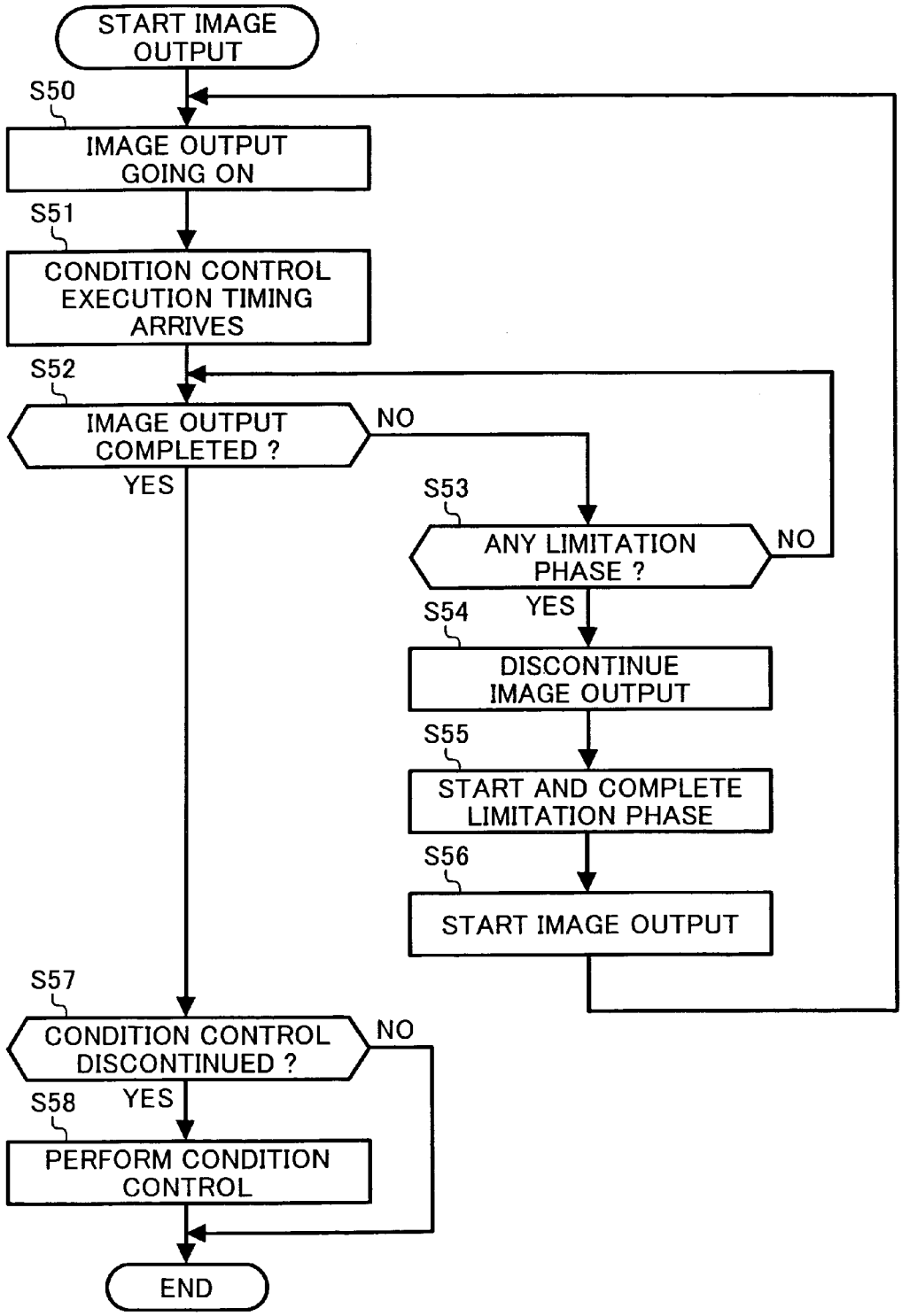
FIG. 17 is a flowchart for explaining a condition control according to another embodiment of the present invention.

In the present embodiment of the condition control illustrated in the flowchart of FIG. 17, when the image output operation is going on (Step S50), if the execution timing of the condition control arrives during the image output operation (Step S51), it is determined whether the image output operation is completed (Step S52). If the image output operation is completed (YES in Step S52), it is then determined whether the condition control is discontinued (Step S57). If the condition control is discontinued (YES in Step S57), the condition control is performed (Step S58). Even when the image output operation is not yet completed (NO in Step S52), if there is any limitation phase (YES in Step S53), the ongoing image output operation is discontinued (Step S54). Then, at least the limitation phase is performed (Step S55), and the image output operation is resumed (Step S56).

In the present embodiment of the condition control described above, the image output operation may be interrupted by the condition control under a condition in which the number of sheets output from the image forming apparatus 100 exceeds the predetermined number of output sheets by a predetermined value, for example. It is preferable to set the predetermined value to be a value equal to or lower than a threshold value beyond which the image quality is noticeably deteriorated. The predetermined value may be set individually for each of the phases, or may be calculated through a simple arithmetic operation based on the predetermined number of output sheets. The predetermined value, which is an integer number indicating the number of sheets, may be converted to an integer number by a general rounding-off method, if any decimal fraction is produced by the arithmetic operation.

Figure 18:
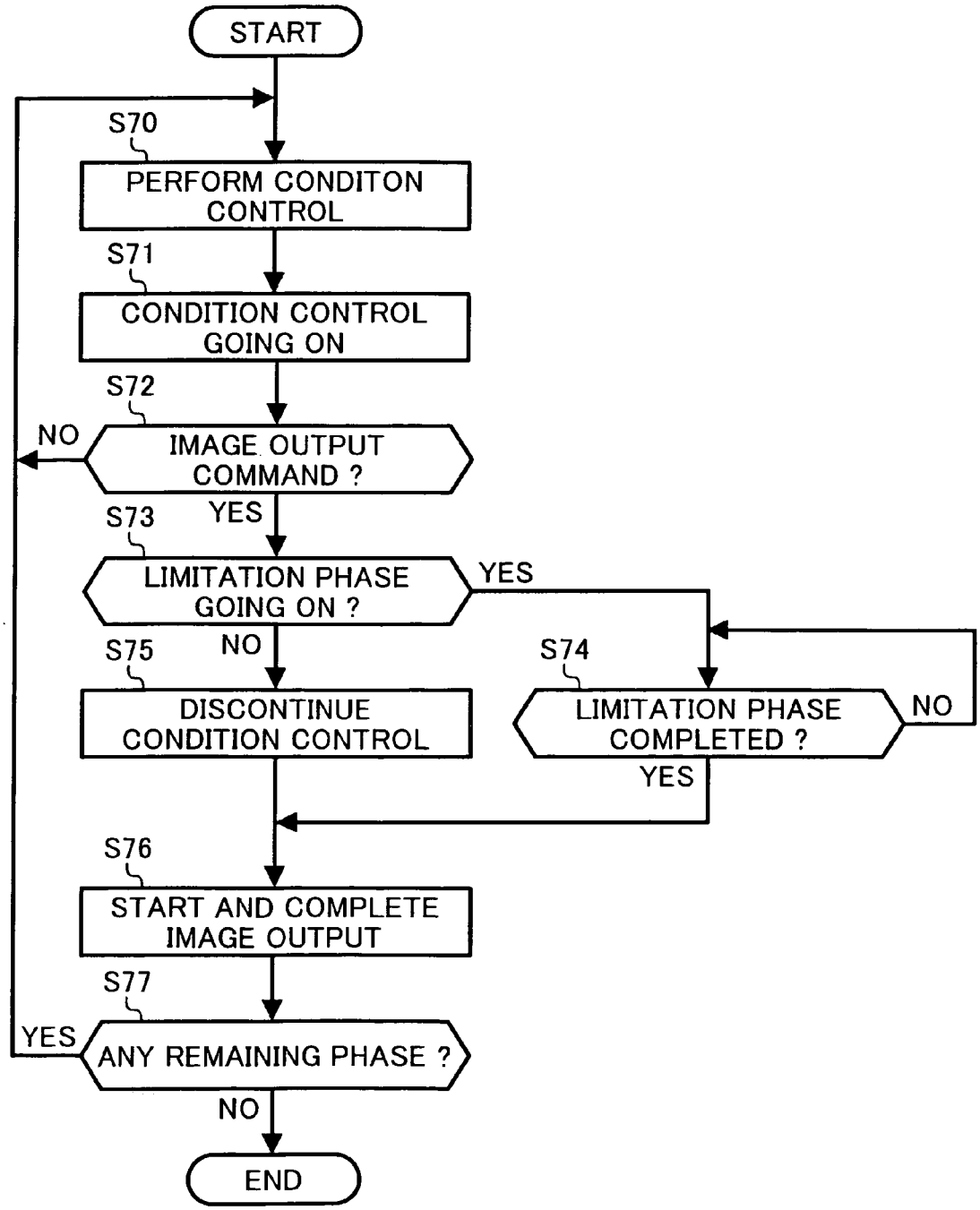
FIG. 18 is a flowchart for explaining a condition control according to another embodiment of the present invention.

Conversely, when the image output command is received during the condition control, and if the limitation phase is going on in the condition control, the limitation phase is not discontinued and the image output operation is suspended until the limitation phase is completed. An operation flow to be followed in this case, which is another embodiment of the condition control, is described below with reference to the flowchart of FIG. 18.

When the condition control is started (Step S70) and going on (Step S71), if the image output command is received during the condition control (YES in Step S72), and if the limitation phase is going on (YES in Step S73), the ongoing limitation phase is completed (YES in Step S74). Then, the image output operation is started (Step S76). If the limitation phase is not going on (NO in Step S73), the condition control is immediately discontinued (Step S75), and the image output operation is started and completed (Step S76). Thereafter, it is determined whether there is any remaining phase of the condition control (Step S77). If there is any remaining phase of the condition control (YES in Step S77), the operation flow returns to Step S70 to perform the remaining phase of the condition control. If there is no remaining phase of the condition control, the operation flow ends.

Another embodiment of the condition control is described with reference to the table of FIG. 19. In the earlier embodiment illustrated in FIGS. 9 and 10, a plurality of phases of the condition control are concurrently performed. If the number of phases to be concurrently performed is decreased, concern about the priority order in executing the phases and possibility of repeated discontinuation of a particular phase are reduced. As illustrated in the table of FIG. 19, in the present embodiment, the predetermined number of sheets output in one of the phases forming the condition control, which determines the execution frequency of the phase, is set as much as possible so as not to be a multiple number of the predetermined number of sheets output in another phase. Further, to determine the execution timing of each phase, a counter for counting the number of output sheets is provided for each one of the phases.

With the present embodiment thus designed, cooccurrence frequency of a plurality of phases, excluding Phase PH3 (i.e., control of toner supply) performed after output of every sheet, can be known by obtaining the least common multiple number of the accumulated number of sheets output in each of the phases and making comparison between the obtained least common multiple numbers. It is found from the comparison that cooccurrence of the execution timings is observed most frequently between Phases PH2 and PH7. In this case, the cooccurrence frequency of the two phases is once every 1170 sheets. Further, three phases which most frequently cooccur are Phases PH2, PH7, and PH6. In this case, the cooccurrence frequency of the three phases is once every 40950 sheets. In reality, each phase is not performed immediately after arrival of the execution timing of the phase but after completion of the ongoing image output operation. Therefore, the cooccurrence of the phases may not occur exactly at the frequencies described above. Notwithstanding this, according to the present embodiment, possibility of cooccurrence of a plurality of phases can be substantially reduced. Further, according to the present embodiment, most phases of the condition control are performed exclusively with Phase PH3. Therefore, possibility of interruption of the condition control by the image output operation is also substantially reduced.

Another embodiment of the condition control is described below. Some image forming apparatuses store an image in a memory before performing the image output operation to output the image. Most of this type of image forming apparatuses can accept, even during the image output operation, requests for a plurality of jobs to be performed subsequently to the ongoing image output operation, and sequentially store the requests in the memory.

If the execution timing of the condition control arrives in a state in which a plurality of jobs are suspended as in the above case, it is undesirable to wait for completion of all of the plurality of jobs before starting the condition control. Therefore, in a state in which a plurality of phases should be performed in the condition control, a combination of, for example, a phase of the shortest execution time and a job of the smallest number of sheets to be output is preferentially performed. If there are any remaining phases and jobs, appropriate combinations are formed between the phases and the jobs in the manner as described above, and the phase and the job are alternately performed. Accordingly, a substantially long waiting time and substantial deterioration of the image quality can be prevented. Consequently, the order of job performance becomes different from the order of job acceptance.

In general, a user tends to expect immediate output of sheets, when the number of the sheets requested to be output is relatively small. Further, the user presumably issues the image output command with an assumption that output of a relatively large number of sheets takes time. Therefore, if the phases of the condition control are performed in combination with the image output operations in the manner as described above, it is expected that the user will not feel very uncomfortable toward the waiting time.

In the present embodiment, if the above combination of the phase of the shortest execution time and the job of the smallest number of sheets to be output is replaced by a combination of a phase of the highest execution frequency and the job of the smallest number of sheets to be output, the deterioration of the image quality can be minimized.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. An image forming apparatus comprising:

an image forming mechanism configured to perform an image forming operation and a control operation of image forming process conditions, the control operation comprising at least two phases each executable at an individual time; and a process controller configured to instruct the image forming mechanism to perform the control operation by executing the at least two phases in an order of execution frequency from the highest execution frequency to the lowest execution frequency, and to discontinue sequential execution of the at least two phases forming the control operation in accordance with an image output command to preferentially perform an image output operation in accordance with the image output command, wherein, when the process controller receives the image output command during one phase of the control operation, the process controller is configured to instruct the image forming mechanism to immediately discontinue the control operation, if remaining time before completion of the phase is equal to or more than a predetermined time.

2. The image forming apparatus as described in claim 1, wherein the process controller is configured to instruct the image forming mechanism to discontinue the control operation upon receipt of the image output command.

3. The image forming apparatus as described in claim 1, wherein the process controller is configured to instruct the image forming mechanism to discontinue the control operation upon completion of one phase of the control operation during which the image output command is received.

4. The image forming apparatus as described in claim 1, wherein, when the process controller receives the image output command during one phase of the control operation, the process controller is configured to discontinue the control operation upon completion of the one phase, if the remaining time before completion of the one phase is less than the predetermined time.

5. The image forming apparatus as described in claim 1, wherein the predetermined time is set to be an arbitrary value.

6. The image forming apparatus as described in claim 1, wherein the process controller is configured to instruct the image forming mechanism to resume discontinued phases of the control operation after completion of the image output operation.

7. The image forming apparatus as described in claim 6, wherein the process controller is configured to instruct the image forming mechanism to perform the discontinued phases of the control operation in an order of execution time length from the shortest time length to the longest time length, regardless of a priority order given to the phases prior to discontinuation of the control operation.

8. The image forming apparatus as described in claim 6, wherein the process controller is configured to instruct the image forming mechanism to perform the discontinued phases of the control operation in an order of execution frequency from the highest execution frequency to the lowest execution frequency, regardless of a priority order given to the at least two phases prior to discontinuation of the control operation.

9. The image forming apparatus as described in claim 6, wherein, if the number of sheets output from the image forming apparatus exceeds, by a predetermined value, a predetermined number of sheets allowed to be output in one phase of the resumed control operation, the process controller is configured to instruct the image forming mechanism to preferentially perform the one phase, and wherein the predetermined number of sheets determines an execution frequency of the phase.

10. The image forming apparatus as described in claim 9, wherein the predetermined value is expressed by an integer number obtained by multiplying the predetermined number of sheets by a predetermined rate.

11. The image forming apparatus as described in claim 6, wherein, when the process controller receives another image output command after discontinuation of the control operation, the process controller is configured to change an execution order of the discontinued phases of the control operation in accordance with a number of sheets requested to be output by the another image output command, regardless of a priority order given to the at least two phases prior to the discontinuation of the control operation.

12. The image forming apparatus as described in claim 6, wherein, when the process controller receives another image output command during one phase of the resumed control operation, the process controller is configured to instruct the image forming mechanism to discontinue the resumed control operation again after completion of the one phase.

13. The image forming apparatus as described in claim 6, wherein, when the process controller receives another image output command, the process controller is configured to instruct the image forming mechanism not to discontinue the resumed control operation again.

14. The image forming apparatus as described in claim 1, wherein the process controller is configured to instruct the image forming mechanism to resume discontinued phases of the control operation after elapse of a predetermined time since completion of the image output operation.

15. The image forming apparatus as described in claim 14, wherein the predetermined time is determined in accordance with a number of sheets output in the image output operation.

16. The image forming apparatus as described in claim 15, wherein the predetermined time is set to be zero when the number of sheets output in the image output operation exceeds a predetermined value.

17. The image forming apparatus as described in claim 14, wherein the predetermined time is set to be an arbitrary value.

18. The image forming apparatus as described in claim 14, wherein, when timing of resuming the discontinued phases of the control operation arrives during another image output operation, the process controller is configured to instruct the image forming mechanism to resume the discontinued phases upon completion of the another image output operation.

19. The image forming apparatus as described in claim 1, wherein, when the process controller determines either one of that any operation is being performed in accordance with the image output command and that the image output operation is being performed, the process controller is configured to instruct the image forming mechanism to suspend at least either one of a start of the control operation and a resumption of the discontinued control operation.

20. An image forming apparatus comprising:

an image forming mechanism configured to perform an image forming operation and a control operation of image forming process conditions, the control operation comprising at least two phases each executable at an individual time; and a process controller configured to instruct the image forming mechanism to perform the control operation by executing the at least two phases in an order of execution time length from the shortest time length to the longest time length, and to discontinue sequential execution of the at least two phases forming the control operation in accordance with an image output command to preferentially perform an image output operation in accordance with the image output command, wherein, when the process controller receives the image output command during one phase of the control operation, the process controller is configured to instruct the image forming mechanism to immediately discontinue the control operation, if remaining time before completion of the phase is equal to or more than a predetermined time.

21. An image forming apparatus comprising:

an image forming mechanism configured to perform an image forming operation and a control operation of image forming process conditions, the control operation comprising at least two phases each executable at an individual time;

a first memory configured to store data; and a process controller configured to instruct the image forming mechanism to perform the control operation, to discontinue sequential execution of the at least two phases forming the control operation in accordance with an image output command to preferentially perform an image output operation in accordance with the image output command, to store in the first memory data of discontinuation frequency of discontinued phases, and to perform the discontinued phases in an order of the discontinuation frequency from the highest discontinuation frequency to the lowest discontinuation frequency, wherein, when the process controller receives the image output command during one phase of the control operation, the process controller is configured to instruct the image forming mechanism to immediately discontinue the control operation, if remaining time before completion of the phase is equal to or more than a predetermined time.

22. An image forming apparatus comprising:

an image forming mechanism configured to perform an image forming operation and a control operation of image forming process conditions, the control operation comprising at least two phases each executable at an individual time; and a process controller configured to instruct the image forming mechanism to perform the control operation by executing the at least two phases in an order of execution frequency from the highest execution frequency to the lowest execution frequency, and to discontinue sequential execution of the at least two phases forming the control operation in accordance with an image output command to preferentially perform an image output operation in accordance with the image output command, wherein, when the process controller determines either one of that any operation is being performed in accordance with the image output command and that the image output operation is being performed, the process controller is configured to instruct the image forming mechanism to immediately perform one phase of the control operation, if a number of sheets output from the image forming apparatus exceeds, by a predetermined value, a predetermined number of sheets allowed to be output in the one phase which determines an execution frequency of the one phase.

23. The image forming apparatus as described in claim 22, wherein the predetermined value is expressed by an integer number obtained by multiplying the predetermined number of sheets by a predetermined rate.

24. An image forming apparatus comprising:

an image forming mechanism configured to perform an image forming operation and a control operation of image forming process conditions, the control operation comprising at least two phases each executable at an individual time;

a process controller configured to instruct the image forming mechanism to perform the control operation by executing the at least two phases in an order of execution frequency from the highest execution frequency to the lowest execution frequency, and to discontinue sequential execution of the at least two phases forming the control operation in accordance with an image output command to preferentially perform an image output operation in accordance with the image output command; and a second memory configured to previously store image data to be output, wherein, when execution timing of the control operation arrives in a state in which an image output operation is being performed and requests for a plurality of other image output operations are accumulated in the second memory, the process controller is configured to change, after completion of the image output operation, an execution order of at least either one of the plurality of other image output operations and the at least two phases of the control operation in accordance with a number of sheets to be output in each of the plurality of other image output operations.

25. The image forming apparatus as described in claim 24, wherein, when the control operation includes a plurality of respective phases, the process controller is configured to instruct the image forming mechanism to arrange the plurality of respective phases of the control operation in an order of execution time length from the shortest time length to the longest time length and to arrange the plurality of other image output operations in an order of the number of sheets to be output from the smallest number to the largest number, and alternately to perform the plurality of respective phases and the plurality of other image output operations in respective arranged orders.

26. The image forming apparatus as described in claim 24, wherein, when the control operation includes a plurality of respective phases, the process controller is configured to instruct the image forming mechanism to arrange the plurality of phases of the control operation in an order of execution frequency from the highest execution frequency to the lowest execution frequency and to arrange the plurality of other image output operations in an order of the number of sheets to be output from the smallest number to the largest number, and alternately to perform the plurality of respective phases and the plurality of other image output operations in respective arranged orders.

27. An image forming apparatus comprising:

an image forming mechanism configured to perform an image forming operation and a control operation of image forming process conditions, the control operation comprising at least two phases each executable at an individual time; and a process controller configured to instruct the image forming mechanism to perform the control operation by executing the at least two phases in an order of execution frequency from the highest execution frequency to the lowest execution frequency, and to discontinue sequential execution of the at least two phases forming the control operation in accordance with an image output command to preferentially perform an image output operation in accordance with the image output command, wherein a predetermined number of sheets allowed to be output in one phase of the control operation, which determines the execution frequency of the phase, is set so as not to be a multiple number of a predetermined number of sheets allowed to be output in another phase of the control operation.

28. An image forming apparatus comprising:

image forming means for performing an image forming operation and a control operation of image forming process conditions, the control operation comprising at least two phases each executable at an individual time; and process controlling means for instructing the image forming means to perform the control operation by executing the at least two phases in an order of execution frequency from the highest frequency to the lowest frequency, and to discontinue sequential execution of the at least two phases forming the control operation in accordance with an image output command to preferentially perform an image output operation in accordance with the image output commands, wherein, when the process controlling means receives the image output command during one phase of the control operation, the process controlling means is configured to instruct the image forming means to immediately discontinue the control operation, if remaining time before completion of the phase is equal to or more than a predetermined time.

29. The image forming apparatus as described in claim 28, wherein the process controlling means instructs the image forming means to discontinue the control operation upon receipt of the image output command.

30. The image forming apparatus as described in claim 28, wherein the process controlling means instructs the image forming means to discontinue the control operation upon completion of a phase of the control operation during which the image output command is received.

31. The image forming apparatus as described in claim 28, wherein, when the process controlling means receives the image output command during one phase of the control operation, the process controlling means instructs the image forming means to discontinue the control operation upon completion of the one phase, if the remaining time before completion of the one phase is less than the predetermined time.

32. The image forming apparatus as described in claim 28, wherein the predetermined time is set to be an arbitrary value.

33. The image forming apparatus as described in claim 28, wherein the process controlling means instructs the image forming means to resume discontinued phases of the control operation after completion of the image output operation.

34. The image forming apparatus as described in claim 33, wherein the process controlling means instructs the image forming means to perform the discontinued phases of the control operation in an order of execution time length from the shortest time length to the longest time length, regardless of a priority order given to the phases prior to discontinuation of the control operation.

35. The image forming apparatus as described in claim 33, wherein the process controlling means instructs the image forming means to perform the discontinued phases of the control operation in an order of execution frequency from the highest execution frequency to the lowest execution frequency, regardless of a priority order given to the at least two phases prior to discontinuation of the control operation.

36. The image forming apparatus as described in claim 33, wherein, if the number of sheets output from the image forming apparatus exceeds, by a predetermined value, a predetermined number of sheets allowed to be output in one phase of the resumed control operation, the process controlling means instructs the image forming means to preferentially performs the one phase, and wherein the predetermined number of sheets determines an execution frequency of the phase.

37. The image forming apparatus as described in claim 36, wherein the predetermined value is expressed by an integer number obtained by multiplying the predetermined number of sheets by a predetermined rate.

38. The image forming apparatus as described in claim 33, wherein, when the process controlling means receives another image output command after discontinuation of the control operation, the process controlling means changes an execution order of the discontinued phases of the control operation in accordance with a number of sheets requested to be output by the another image output command, regardless of a priority order given to the at least two phases prior to the discontinuation of the control operation.

39. The image forming apparatus as described in claim 33, wherein, when the process controlling means receives another image output command during one phase of the resumed control operation, the process controlling means instructs the image forming means to discontinue the resumed control operation again after completion of the one phase.

40. The image forming apparatus as described in claim 33, wherein, when the process controlling means receives another image output command, the process controlling means instructs the image forming means not to discontinue the resumed control operation again.

41. The image forming apparatus as described in claim 28, wherein the process controlling means instructs the image forming means to resume discontinued phases of the control operation after elapse of a predetermined time since completion of the image output operation.

42. The image forming apparatus as described in claim 41, wherein the predetermined time is determined in accordance with a number of sheets output in the image output operation.

43. The image forming apparatus as described in claim 42, wherein the predetermined time is set to be zero when the number of sheets output in the image output operation exceeds a predetermined value.

44. The image forming apparatus as described in claim 41, wherein the predetermined time is set to be an arbitrary value.

45. The image forming apparatus as described in claim 41, wherein, when timing of resuming the discontinued phases of the control operation arrives during another image output operation, the process controlling means instructs the image forming means to resume the discontinued phases upon completion of the another image output operation.

46. The image forming apparatus as described in claim 28, wherein, when the process controlling means determines either one of that any operation is being performed in accordance with the image output command and that the image output operation is being performed, the process controlling means instructs the image forming means to suspend at least either one of a start of the control operation and a resumption of the discontinued control operation.

47. An image forming apparatus comprising:

image forming means for performing an image forming operation and a control operation of image forming process conditions, the control operation comprising at least two phases each executable at an individual time; and process controlling means for instructing the image forming means to perform the control operation by executing the at least two phases in an order of execution time length from the shortest time length to highest time length, and to discontinue sequential execution of the at least two phases forming the control operation in accordance with an image output command to preferentially perform an image output operation in accordance with the image output command, wherein, when the process controlling means receives the image output command during one phase of the control operation, the process controlling means is configured to instruct the image forming means to immediately discontinue the control operation, if remaining time before completion of the phase is equal to or more than a predetermined time.

48. An image forming apparatus comprising:

image forming means for performing an image forming operation and a control operation of image forming process conditions, the control operation comprising at least two phases each executable at an individual time;

first memory means for storing data; and process controlling means for instructing the image forming means to perform the control operation, to discontinue sequential execution of the at least two phases forming the control operation in accordance with an image output command to preferentially perform an image output operation in accordance with the image output command, to store in the first memory means data of discontinuation frequency of discontinued phases, and to perform the discontinued phases in an order of the discontinuation frequency from the highest discontinuation frequency to the lowest discontinuation frequency, wherein, when the process controlling means receives the image output command during one phase of the control operation, the process controlling means is configured to instruct the image forming means to immediately discontinue the control operation, if remaining time before completion of the phase is equal to or more than a predetermined time.

49. An image forming apparatus comprising:

image forming means for performing an image forming operation and a control operation of image forming process conditions, the control operation comprising at least two phases each executable at an individual time; and process controlling means for instructing the image forming means to perform the control operation by executing the at least two phases in an order of execution frequency from the highest frequency to the lowest frequency, and to discontinue sequential execution of the at least two phases forming the control operation in accordance with an image output command to preferentially perform an image output operation in accordance with the image output command, wherein, when the process controlling means determines either one of that any operation is being performed in accordance with the image output command and that the image output operation is being performed, the process controlling means instructs the image forming means to immediately perform one phase of the control operation, if a number of sheets output from the image forming apparatus exceeds, by a predetermined value, a predetermined number of sheets allowed to be output in the one phase which determines an execution frequency of the one phase.

50. The image forming apparatus as described in claim 49, wherein the predetermined value is expressed by an integer number obtained by multiplying the predetermined number of sheets by a predetermined rate.

51. An image forming apparatus comprising:

image forming means for performing an image forming operation and a control operation of image forming process conditions, the control operation comprising at least two phases each executable at an individual time;

process controlling means for instructing the image forming means to perform the control operation by executing the at least two phases in an order of execution frequency from the highest frequency to the lowest frequency, and to discontinue sequential execution of the at least two phases forming the control operation in accordance with an image output command to preferentially perform an image output operation in accordance with the image output command; and second memory means for previously storing image data to be output, wherein, when execution timing of the control operation arrives in a state in which an image output operation is being performed and requests for a plurality of other image output operations are accumulated in the second memory means, the process controlling means changes, after completion of the image output operation, an execution order of at least either one of the plurality of other image output operations and the at least two phases of the control operation in accordance with a number of sheets to be output in each of the plurality of other image output operations.

52. The image forming apparatus as described in claim 51, wherein, when the control operation includes a plurality of respective phases, the process controlling means instructs the image forming means to arrange the plurality of respective phases of the control operation in order of execution time length from the shortest time length to the longest time length and the plurality of image output operations in an order of the number of sheets to be output from the smallest number to the largest number, and alternately perform the plurality of respective phases and the plurality of other image output operations in respective arranged orders.

53. The image forming apparatus as described in claim 51, wherein, when the control operation includes a plurality of respective phases, the process controlling means instructs the image forming means to arrange the plurality of respective phases of the control operation in an order of execution frequency from the highest execution frequency to the lowest execution frequency and to arrange the plurality of other image output operations in an order of a number of sheets to be output from the smallest number to the largest number, and alternately to perform the plurality of respective phases and the plurality of other image output operations in respective arranged orders.

54. An image forming apparatus comprising:

image forming means for performing an image forming operation and a control operation of image forming process conditions, the control operation comprising at least two phases each executable at an individual time; and process controlling means for instructing the image forming means to perform the control operation by executing the at least two phases in an order of execution frequency from the highest frequency to the lowest frequency, and to discontinue sequential execution of the at least two phases forming the control operation in accordance with an image output command to preferentially perform an image output operation in accordance with the image output command, wherein a predetermined number of sheets allowed to be output in one phase of the control operation, which determines the execution frequency of the phase, is set so as not to be a multiple number of a predetermined number of sheets allowed to be output in another phase of the control operation.

55. An image forming method comprising:

forming a control operation of image forming process conditions with at least two phases each executable at an individual time;

executing the at least two phases of the control operation in an order of execution frequency from the highest frequency to the lowest frequency;

discontinuing sequential execution of the at least two phases of the control operation in accordance with an image output command;

performing an image output operation in accordance with the image output command;

receiving the image output command during one phase of the control operation;

determining whether remaining time before completion of the one phase is equal to or more than a predetermined time; and discontinuing the control operation when it is determined that the remaining time is equal to or more than the predetermined time.

56. The image forming method as described in claim 55, wherein the discontinuing step discontinues the control operation upon receipt of the image output command.

57. The image forming method as described in claim 55, wherein the discontinuing step discontinues the control operation upon completion of one phase of the control operation during which the image output command is received.

58. The image forming method as described in claim 55, further comprises:

discontinuing the control operation upon completion of the one phase when it is determined that the remaining time before completion of the one phase is less than the predetermined time.

59. The image forming method as described in claim 55, wherein the predetermined time is to be an arbitrary value.

60. The image forming method as described in claim 55, further comprising:

resuming discontinued phases of the control operation after completion of the image output operation.

61. The image forming method as described in claim 60, further comprising:

performing the discontinued phases of the control operation in order of execution time length from the shortest time length to the longest time length, regardless of a priority order given to the phases prior to discontinuation of the control operation.

62. The image forming method as described in claim 60, further comprising:

performing the discontinued phases of the control operation in an order of execution frequency from the highest execution frequency to the lowest execution frequency, regardless of a priority order given to the at least two phases prior to discontinuation of the control operation.

63. The image forming method as described in claim 60, further comprising:

detecting that the number of sheets output from the image forming apparatus exceeds, by a predetermined value, a predetermined number of sheets which is allowed to be output in one phase of the resumed control operation and which determines an execution frequency of the one phase; and performing the phase of the resumed control operation.

64. The image forming method as described in claim 63, wherein the predetermined value is expressed by an integer number obtained by multiplying the predetermined number of sheets by a predetermined rate.

65. The image forming method as described in claim 60, further comprising:

receiving another image output command after discontinuation of the control operation; and changing an execution order of the discontinued phases of the control operation in accordance with a number of sheets requested to be output by the another image output command, regardless of a priority order given to the at least two phases prior to discontinuation of the control operation.

66. The image forming method as described in claim 60, further comprising:

receiving another image output command during one phase of the resumed control operation;

completing the one phase; and discontinuing the resumed control operation again.

67. The image forming method as described in claim 60, further comprising:

receiving another image output command; and completing the resumed control operation without discontinuation.

68. The image forming method as described in claim 55, further comprising:

resuming discontinued phases of the control operation after elapse of a predetermined time since completion of the image output operation.

69. The image forming method as described in claim 68, wherein the predetermined time is determined in accordance with a number of sheets output in the image output operation.

70. The image forming apparatus as described in claim 69, wherein the predetermined time is set to be zero when the number of sheets output in the image output operation exceeds a predetermined value.

71. The image forming method as described in claim 68, wherein the predetermined time is set to be an arbitrary value.

72. The image forming method as described in claim 68, further comprising:

detecting arrival of timing of resuming the discontinued phases of the control operation during another image output operation; and resuming the discontinued phases upon completion of the another image output operation.

73. The image forming method as described in claim 55, further comprising:

determining either one of that any operation is being performed in accordance with the image output command and that the image output operation is being performed; and suspending at least either one of a start of the control operation and a resumption of the discontinued control operation.

74. An image forming method comprising:

forming a control operation of image forming process conditions with at least two phases each executable at an individual time;

executing the at least two phases of the control operation in an order of execution time length from the shortest time length to the longest time length;

discontinuing sequential execution of the at least two phases of the control operation in accordance with an image output command;

performing an image output operation in accordance with the image output command;

receiving the image output command during one phase of the control operation;

determining whether remaining time before completion of the one phase is equal to or more than a predetermined time; and discontinuing the control operation when it is determined that the remaining time is equal to or more than the predetermined time.

75. An image forming method comprising:

forming a control operation of image forming process conditions with at least two phases each executable at an individual time;

executing the at least two phases of the control operation;

discontinuing sequential execution of the at least two phases of the control operation in accordance with an image output command;

storing, in a first memory, data of discontinuation frequency of discontinued phases;

performing an image output operation in accordance with the image output command;

performing the discontinued phases in an order of discontinuation frequency from the highest discontinuation frequency to the lowest discontinuation frequency;

receiving the image output command during one phase of the control operation;

determining whether remaining time before completion of the one phase is equal to or more than a predetermined time; and discontinuing the control operation when it is determined that the remaining time is equal to or more than the predetermined time.

76. An image forming method comprising:

forming a control operation of image forming process conditions with at least two phases each executable at an individual time;

executing the at least two phases of the control operation in an order of execution frequency from the highest frequency to the lowest frequency;

discontinuing sequential execution of the at least two phases of the control operation in accordance with an image output command;

performing an image output operation in accordance with the image output command;

determining either one of that any operation is being performed in accordance with the image output command and that the image output operation is being performed;

determining that a number of sheets output from the image forming apparatus exceeds, by a predetermined value, a predetermined number of sheets which is allowed to be output in one phase of the control operation and which determines an execution frequency of the one phase; and performing the phase of the control operation.

77. The image forming method as described in claim 76, wherein the predetermined value is expressed by an integer number obtained by multiplying the predetermined number of sheets by a predetermined rate.

78. An image forming method comprising:

forming a control operation of image forming process conditions with at least two phases each executable at an individual time;

executing the at least two phases of the control operation in an order of execution frequency from the highest frequency to the lowest frequency;

discontinuing sequential execution of the at least two phases of the control operation in accordance with an image output command;

performing an image output operation in accordance with the image output command;

performing an image output operation;

accumulating, in a second memory configured to previously store image data to be output, requests for a plurality of other image output operations during execution of the image output operation;

detecting arrival of execution timing of the control operation;

completing the image output operation; and changing an execution order of at least either one of the plurality of other image output operations and the at least two phases of the control operation in accordance with a number of sheets to be output in each of the plurality of other image output operations.

79. The image forming method as described in claim 78, further comprising:

including a plurality of respective phases in the control operation;

arranging the plurality of respective phases of the control operation in an order of execution time length from the shortest time length to the longest time length and the plurality of other image output operations in an order of the number of sheets to be output from the smallest number to the largest number; and alternately performing the plurality of respective phases of the control operation and the plurality of other image output in operations in respective arranged orders.

80. The image forming method as described in claim 78, further comprising:

including a plurality of respective phases in the control operation;

arranging the plurality of respective phases of the control operation in an order of execution frequency from the highest execution frequency to the lowest execution frequency and arranging the plurality of other image output operations in an order of the number of sheets to be output from the smallest number to the largest number; and alternately performing the plurality of respective phases of the control operation and the plurality of other image output in operations in respective arranged orders.

81. An image forming method comprising:

forming a control operation of image forming process conditions with at least two phases each executable at an individual time;

executing the at least two phases of the control operation in an order of execution frequency from the highest frequency to the lowest frequency;

discontinuing sequential execution of the at least two phases of the control operation in accordance with an image output command;

performing an image output operation in accordance with the image output command;

setting a predetermined number of sheets allowed to be output in one phase of the control operation, which determines the execution frequency of the phase, so as not to be a multiple number of a predetermined number of sheets allowed to be output in another phase of the control operation.

* * * * *